US006632034B2

(12) United States Patent
Ikeda et al.

(10) Patent No.: US 6,632,034 B2
(45) Date of Patent: Oct. 14, 2003

(54) PRINTING MACHINE FOR BOOKLET-LIKE MEDIUM

(75) Inventors: Hiroyuki Ikeda, Ibaraki-ken (JP); Susumu Oshio, Ibaraki-ken (JP); Hiroyuki Sunagawa, Ibaraki-ken (JP); Hideo Watanabe, Ibaraki-ken (JP); Hiroshi Hanzawa, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/084,374

(22) Filed: Feb. 28, 2002

(65) Prior Publication Data

US 2002/0122684 A1 Sep. 5, 2002

(30) Foreign Application Priority Data

Mar. 2, 2001 (JP) ..... P2001-058197

(51) Int. Cl.[7] ..... B41J 3/28; B41J 13/26
(52) U.S. Cl. ..... 400/28; 400/27; 400/24
(58) Field of Search ..... 400/24, 25, 27, 400/28

(56) References Cited

U.S. PATENT DOCUMENTS 5,183,347 A * 2/1993 Higuchi et al. ..... 400/583.3
5,806,991 A * 9/1998 Hubler ..... 400/24

FOREIGN PATENT DOCUMENTS

| | | | |
|---|---|---|---|
| GB | 1 237 380 | 6/1971 | |
| JP | 62270354 A | * 11/1987 | ..... B41J/11/02 |
| JP | 07-025093 | 1/1995 | |
| JP | 08-025747 | 1/1996 | |
| JP | 08-156352 | 6/1996 | |
| JP | 09-300773 | 11/1997 | |
| JP | 11-048575 | 2/1999 | |

OTHER PUBLICATIONS

IBM Technical Disclosure Bulletin, "Pass Book for Disk Printer," Jan. 1, 1971, vol. 13, Issue 8, p. 2350.*

* cited by examiner

*Primary Examiner*—Daniel J. Colilla
(74) *Attorney, Agent, or Firm*—Nath & Associates PLLC; Gary M. Nath; Harold L. Novick

(57) ABSTRACT

A printing machine for booklet-like medium (2) is disclosed as having a booklet resting surface (4) to which a sheet insertion passage (5) is opened, a booklet pressing unit (10) which presses booklet-like medium, which is centrally unfolded on the booklet resting surface at a bound portion (2*b*) and whose sheet (2*a*1) of a page to be printed and inserted through the sheet insertion passage, against the booklet resting surface, a print page positioning unit (40) composed of a pair of sheet hazing rollers (42*a*, 42*b*) for positioning the sheet (2*a*1), of the page to be printed, at a given print position, and a print head section (18) having a pair of right and left print heads (19*a*, 19*b*) mounted at both sides of the sheet (2*a*1) of the page to be printed, respectively.

17 Claims, 27 Drawing Sheets

PRINTING MACHINE FOR BOOKLET-LIKE MEDIUM

BACKGROUND OF THE INVENTION

The present invention relates to a printing machine for booklet-like medium, such as a pocketbook, a diary and a book, which has a plurality of sheets (paper sheets, etc) that are bound at a bound portion.

A prior art printing machine for booklet-like medium is shown in Japanese Patent Provisional Publication No. 9-300773, which is shown in FIG. 1. As shown in FIG. 1, the printing machine 100 for booklet-like medium is shown as including a booklet rest table 102 on which a booklet 101, which is centrally unfolded at a bound portion 101*b*, is placed to allow both sheets 101*a*, 101*a* of pages to be printed to serves as respective upper surfaces, four sets of upper and lower roller pairs 103*a*, 103*b* which move the booklet 101, which is placed on the booklet rest table 102, in an auxiliary scanning direction A2, and a print head 105 which is located above the booklet rest table 102 and is guided with guide shafts 104 to be movable in a main scanning direction A1. And, the print head 105 is positioned at a print start-up position and is moved in the main scanning direction A1 to implement printing at a first line. Upon completion of the printing at the first line, the print head 105 is moved in the auxiliary scanning line by a given amount to perform printing at a second line, with such printing operations being repeatedly carried out in a sequence for thereby performing printing operation on the both sheets 101*a*, 101*a* of the pages to be printed.

By the way, with such a booklet 101 having the plurality of sheets bound at the bound portion 101*b*, when the bound portion 101*b* is centrally unfolded in both sides at a boundary between the both sheet of the pages to be printed, right and left volumes in thickness differ from one another depending on the number of sheets which are divided in right and left areas, with a resultant variation in height position of the pages to be printed.

On one hand, the print head 105 encounters a difficulty in implementing favorable printing unless the print head 105 is located in a given positional relationship with respect to the sheet 101*a* of the page to be printed regardless of the print head 105 being composed of the contact type or non-contact type. For this reason, the prior art printing machine includes a thickness detection means 106 for detecting the thickness of the booklet 101, whose sheet 101*a* of the page to be printed is opened, to produce a detected result based on which the height of the print head 105 is adjusted for thereby maintaining the print head 105 and the sheet 101*a* of the page to be printed in a given positional relationship, and a height adjusting means for maintaining the height of the booklet 101, whose sheet 101*a* of the page to be printed is opened, at a given fixed level by adjusting the height of the booklet for thereby maintaining the print head 105 and the sheet 101*a* of the page to be printed in a given positional relationship.

Also, similar technologies related to the above prior art practice are disclosed in Japanese Patent Provisional Publication No. 7-25093, Japanese Patent Provisional Publication No. 8-25747 and Japanese Patent Provisional Publication No. 8-156352.

However, such a prior art printing machine 100 for the booklet-like medium encounters an issue wherein there is a need for providing various detection means and adjusting means responsive to these detection means for maintaining the print head 105 and the sheet 101*a* of the page to be printed.

Another issue is encountered in such a prior art practice in that when the booklet 101 is centrally unfolded in both sides at the bound portion 101*b* with respect to a boundary between the both sheets 101*a*, 101*a* of the pages to be printed, both sheets 101*a*, 101*a* of the pages to be printed normally tend to have respective curved regions in the vicinity of the bound portion 101*b* where deformations in printing are induced. Particularly, in an event that the booklet has a large number of sheets 101*a* that are bound and the sheets 101*a* lack firmness, large curved areas are formed over extended regions when the bound portion 101*b* is centrally unfolded in both sides, resulting in an extremely deteriorated repeatability in printing and, in some cases, resulting printed result which is of no value as a printed product.

SUMMARY OF THE INVENTION

The present invention has been made to address the above issues and has an object of the present invention to provide a printing machine for a booklet-like medium which is able to perform printing operation in an appropriate printing condition regardless of a difference in right and left volumes of thickness occurring when a bound portion of the booklet-like medium is centrally unfolded without causing a sheet of a page to be printed from being formed with a curved surface.

According to a first aspect of the present invention, there is provided a printing machine, for booklet-like medium, which has a booklet resting surface to which a sheet insertion passage is opened, which comprises a booklet pressing unit for pressing the booklet-like medium, which is centrally unfolded on the booklet resting surface at a bound portion with a sheet, of a page to be printed, that is inserted to the sheet insertion passage, against the booklet resting surface; a print page positioning unit for positioning the sheet, of the page to be printed and inserted through the sheet insertion passage, at a given print position; and a print head section for printing on at least one surface of the sheet, of the page to be printed, which is positioned with the print page positioning unit.

With such a printing machine for the booklet-like medium, although there is a condition where different volumes of thickness are obtained in dependence on the number of sheets divided into right and left sides when the bound portion of the booklet-like medium is centrally unfolded at a boundary of a sheet of a page to be printed, the booklet-like medium, which is unfolded in both sides, is pressed against the booklet resting surface with the booklet pressing unit and, also, only the sheet of the page to be printed is inserted through the sheet insertion passage to allow the inserted sheet to be positioned with the print page positioning unit whereby, when the bound portion is centrally unfolded at the boundary of the sheet of the page to be printed, the printing operation is performed under a condition wherein the sheet is positioned in a fixed place with the print page positioning unit without being adversely affected with the volumes of the thickness of the sheets or the curved surfaces thereof.

A second aspect of the present invention relates to the printing machine for booklet-like medium according to the first aspect of the present invention and features that the booklet pressing unit serves to press a backbone of the booklet-like medium against the booklet resting surface.

Such a printing machine for booklet-like medium has, in addition to the function of the first aspect of the present invention, the bound portion of the booklet-like medium is directly exerted with the press force of the booklet pressing unit in a direction toward the booklet resting surface, enabling the bound portion to be pressed against the booklet resting surface to be closer thereto in an effective manner with a weak magnitude of press force.

A third aspect of the present invention relates to a printing machine for booklet-like medium and characterize that the print head section includes a pair of print heads located at both sides of the sheet, of the page to be printed and inserted through the sheet insertion passage, respectively, for performing a double-sided printing operation; and the print page positioning unit includes a pair of sheet pressing members which are movable in an interlocking relationship with the pair of print heads movable in an auxiliary scanning direction, and which serve to pinch the sheet at areas upstream of the auxiliary scanning direction of the print heads during printing operation.

With such a printing machine for booklet-like medium, in addition to the function of the first aspect of the present invention, the sheet is pressed and retained with the pair of sheet pressing members at an area close proximity to a print position where printing is performed with the print head and at the area upstream of the auxiliary scanning direction during the printing operation.

A fourth aspect of the present invention relates to the printing machine for booklet-like medium according to the first aspect of the present invention and features that the print head section includes a print head located at one side of the sheet, of the page to be printed and inserted through the sheet insertion passage, for performing a single-sided printing operation, and the print page positioning unit includes a sheet pressing member which is movable in an interlocking relationship with the print head movable in an auxiliary scanning direction, and a press force rest sheet located at the other side of the sheet, the sheet pressing member serving to press the press force rest sheet at an area upstream of an auxiliary scanning direction of the print head during printing operation.

With such a printing machine for booklet-like medium, in addition to the function of the first aspect of the present invention, the sheet is pressed and retained with the pair of sheet pressing members at an area close proximity to a print position where printing is performed with the print head and at the area upstream of the auxiliary scanning direction during the printing operation.

A fifth aspect of the present invention relates to the printing machine for booklet-like medium according to the third aspect of the present invention and features that the print heads of the print head section are movable in a direction parallel to and perpendicular to a longitudinal direction of the bound portion of the booklet-like medium, respectively.

With such a printing machine for booklet-like medium, in addition to the function of the third aspect of the present invention, it is possible to carry out the printing operation on the two-dimensional zone which the print head is able to scan.

A sixth aspect of the present invention relates to the printing machine for booklet-like medium according to the first aspect of the present invention and features the provision of a sheet size detecting unit for detecting a size of the sheet of the page to be printed and inserted through the sheet insertion passage.

With such a printing machine for booklet-like medium, in addition to the function of the first aspect of the present invention, it is possible for the sheets of the various sizes to be printed at appropriate printing areas. Also, it is possible to preclude an error wherein ink is coated at a region where sheet is not located.

A seventh aspect of the present invention relates to the printing machine for booklet-like medium according to the first aspect of the present invention and features the provision of a sheet inclination detecting unit for detecting an inclination of the sheet of the page to be printed and inserted through the sheet insertion passage.

With such a printing machine for booklet-like medium, in addition to the function of the first aspect of the present invention, the inclination of the sheet of the page to be printed and inserted through the sheet insertion passage is detected with the sheet inclination detecting unit.

An eighth aspect of the present invention relates to the printing machine for booklet-like medium according to the seventh aspect of the present invention and features the provision of a sheet inclination correcting unit for correcting an inclined condition of the sheet of the page to be printed and inserted through the sheet insertion passage, the sheet inclination correcting unit serving to correct the inclined condition of the sheet when the inclined condition of the sheet is detected by the sheet inclination detecting unit.

With such a printing machine for booklet-like medium, in addition to the function of the seventh aspect of the present invention, in an event that the sheet remains in the inclined condition, the inclined condition of the sheet is automatically corrected with the sheet inclination correcting unit.

A ninth aspect of the present invention relates to the printing machine for booklet-like medium according to the eighth aspect of the present invention and features that the sheet inclination correcting unit compels the booklet pressing unit to increase the magnitude of a press force to be exerted to the booklet-like medium.

With such a printing machine for booklet-like medium, in addition to the function of the eighth aspect of the present invention, when the booklet-like medium is strongly pressed against the booklet resting surface with the booklet pressing unit, the bound portion is pressed against and shifted toward the booklet resting surface at an area where the degree of proximity with respect to the booklet resting surface is weak, with a resultant correction in inclined insertion of the sheet of the page to be printed.

According to a tenth aspect of the present invention, there is provided a printing machine, for booklet-like medium having a bound portion, which comprises frame means including a booklet resting surface having a sheet insertion passage adapted to receive sheet of a page to be printed when booklet-like medium is unfolded in both sides on the booklet resting surface; means for pressing the bound portion of booklet-like medium unfolded on the booklet resting surface such that the bound portion is closer to the booklet resting surface; means for positioning the sheet, of the page to be printed and inserted through the sheet insertion passage, at a given print position; and print head means for printing on at least one surface of the sheet, of the page to be printed, which is positioned with the print page positioning unit.

DETAILED DESCRIPTION OF THE PREFERRED EMBODIMENTS

To describe the present invention, booklet-like medium printing machines of preferred embodiments according to the present invention will be described below with reference to the drawings.

Figure 1:
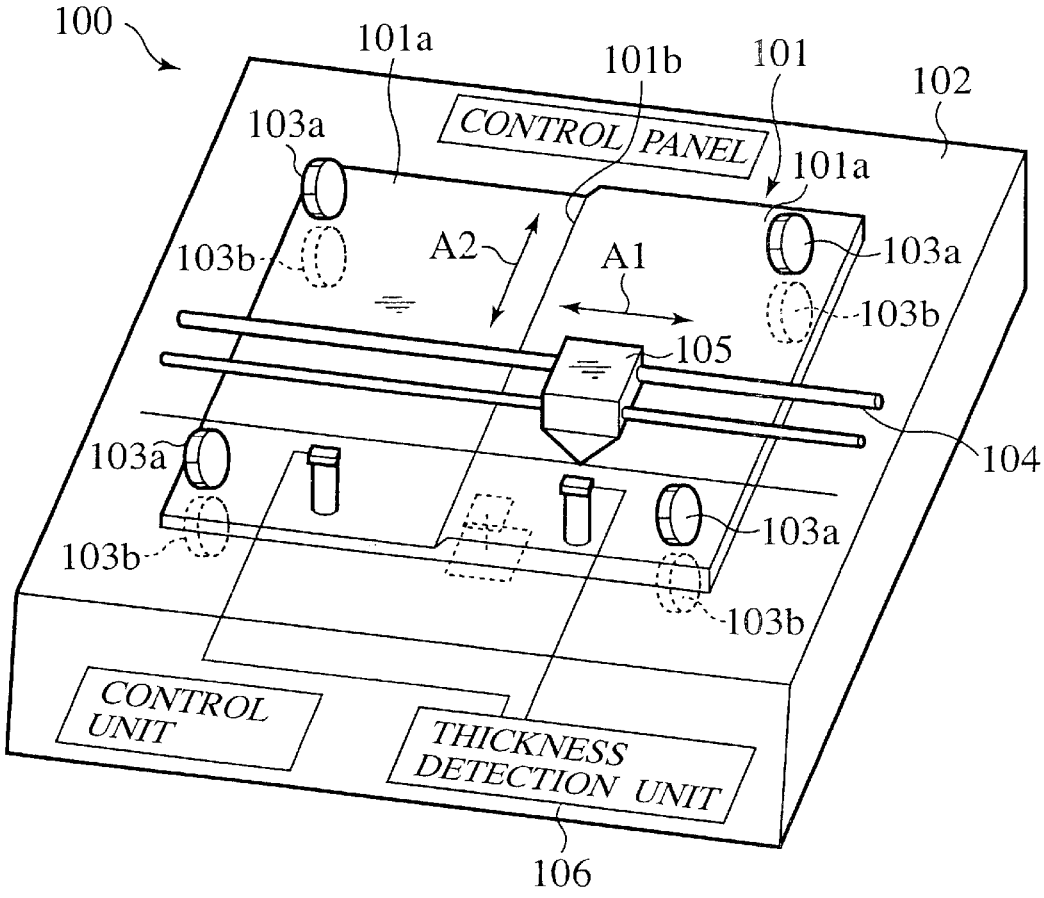
FIG. 1 is a schematic perspective view of a printing machine of a prior art.
Figure 2:
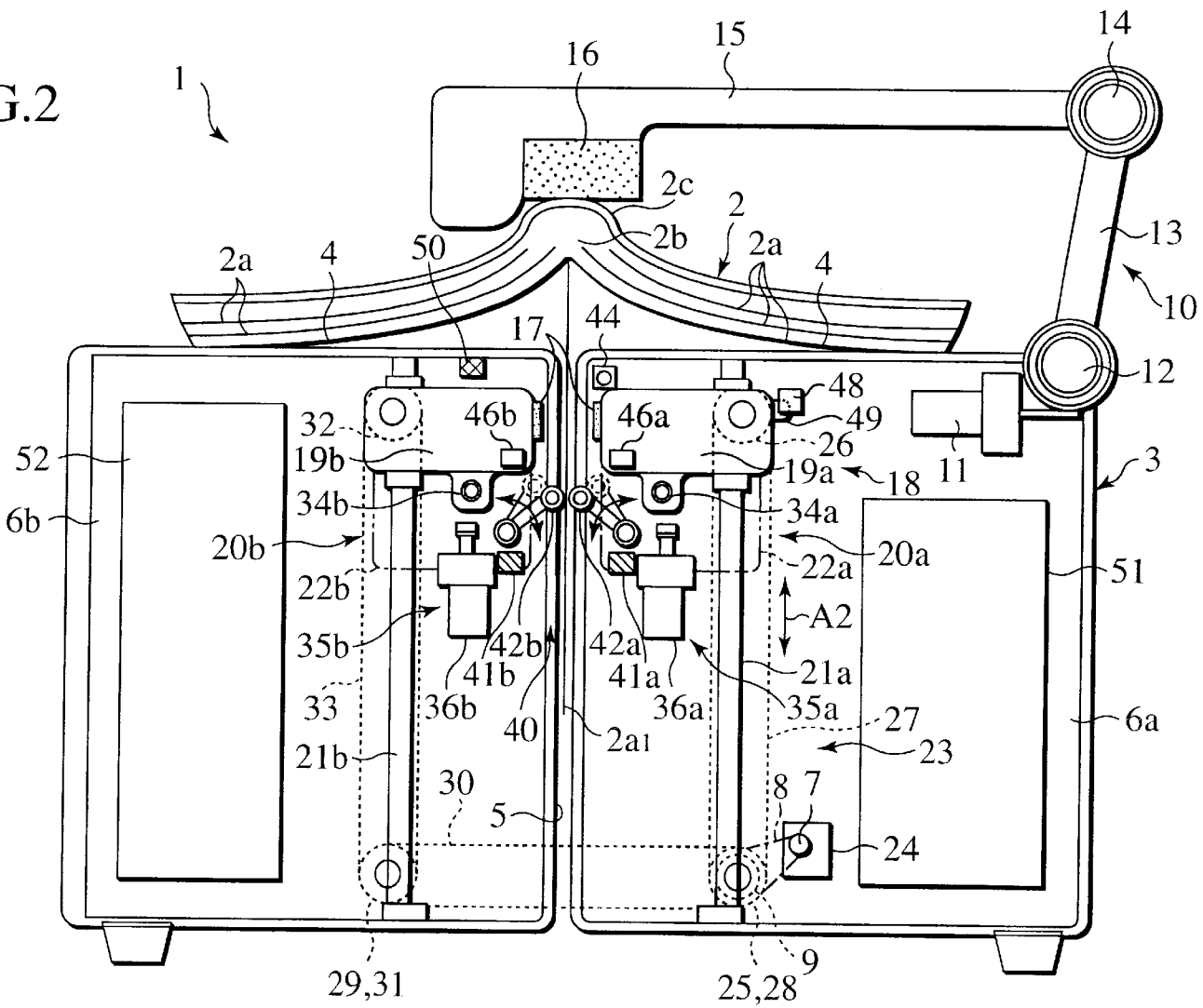
FIG. 2 is a schematic overall structural view, as viewed from a front side, of a double-side printing machine of a first preferred embodiment according to the present invention.
Figure 3:
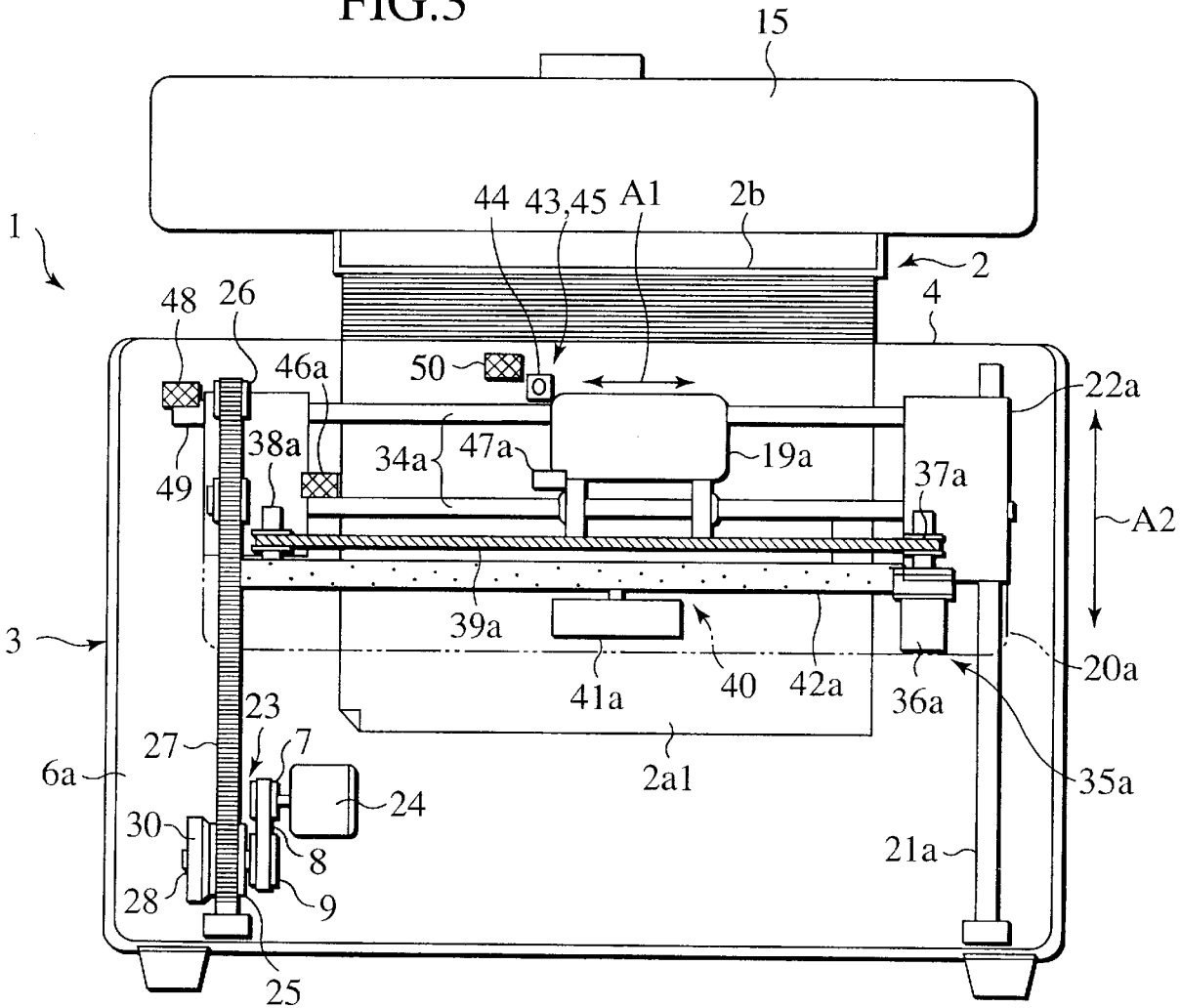
FIG. 3 is a schematic overall structural view, as viewed from a side, of the double-side printing machine of the first preferred embodiment according to the present invention.
Figure 4:
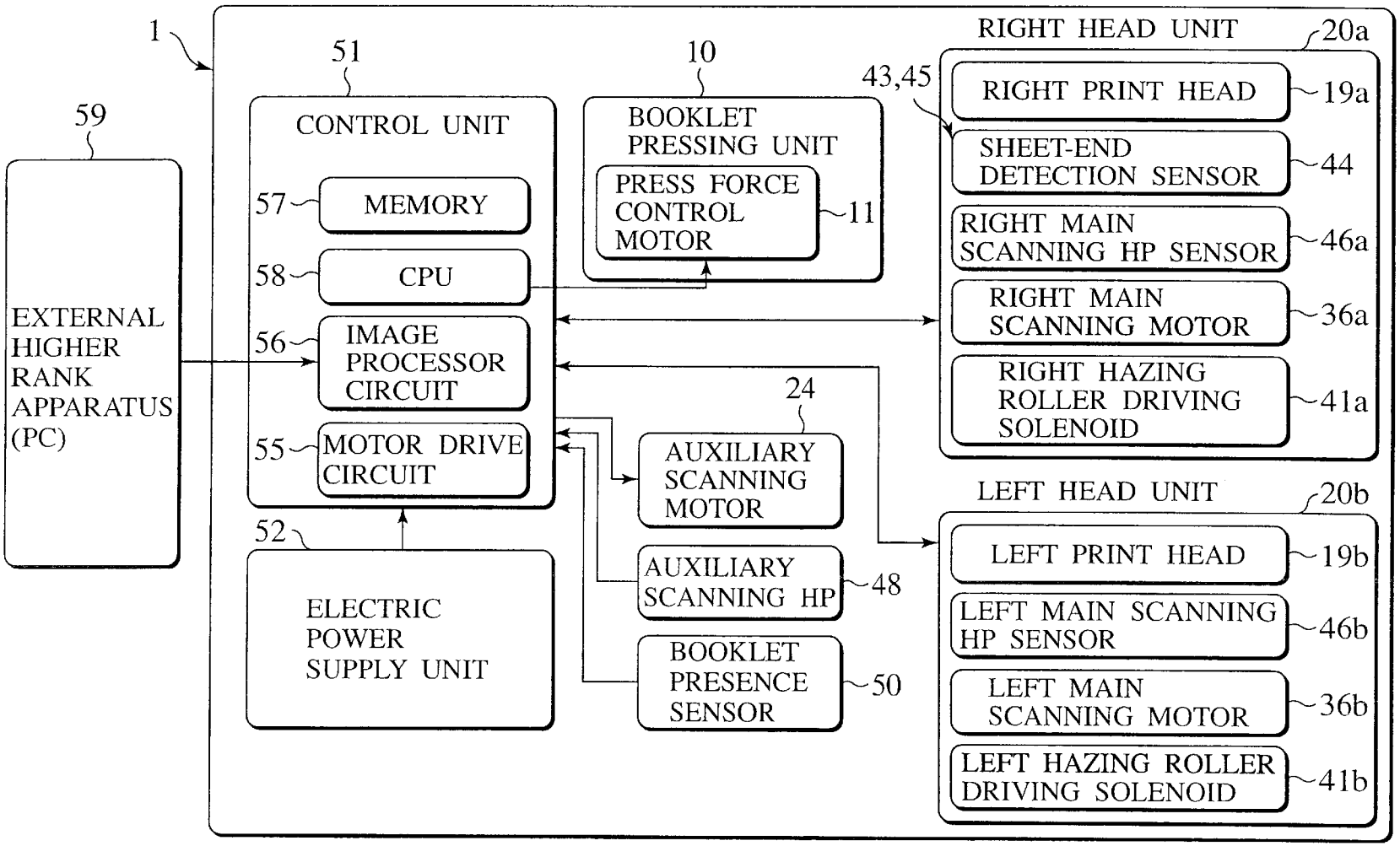
FIG. 4 is a block diagram of a schematic circuit of the double-side printing machine of the first preferred embodiment according to the present invention.
Figure 5:
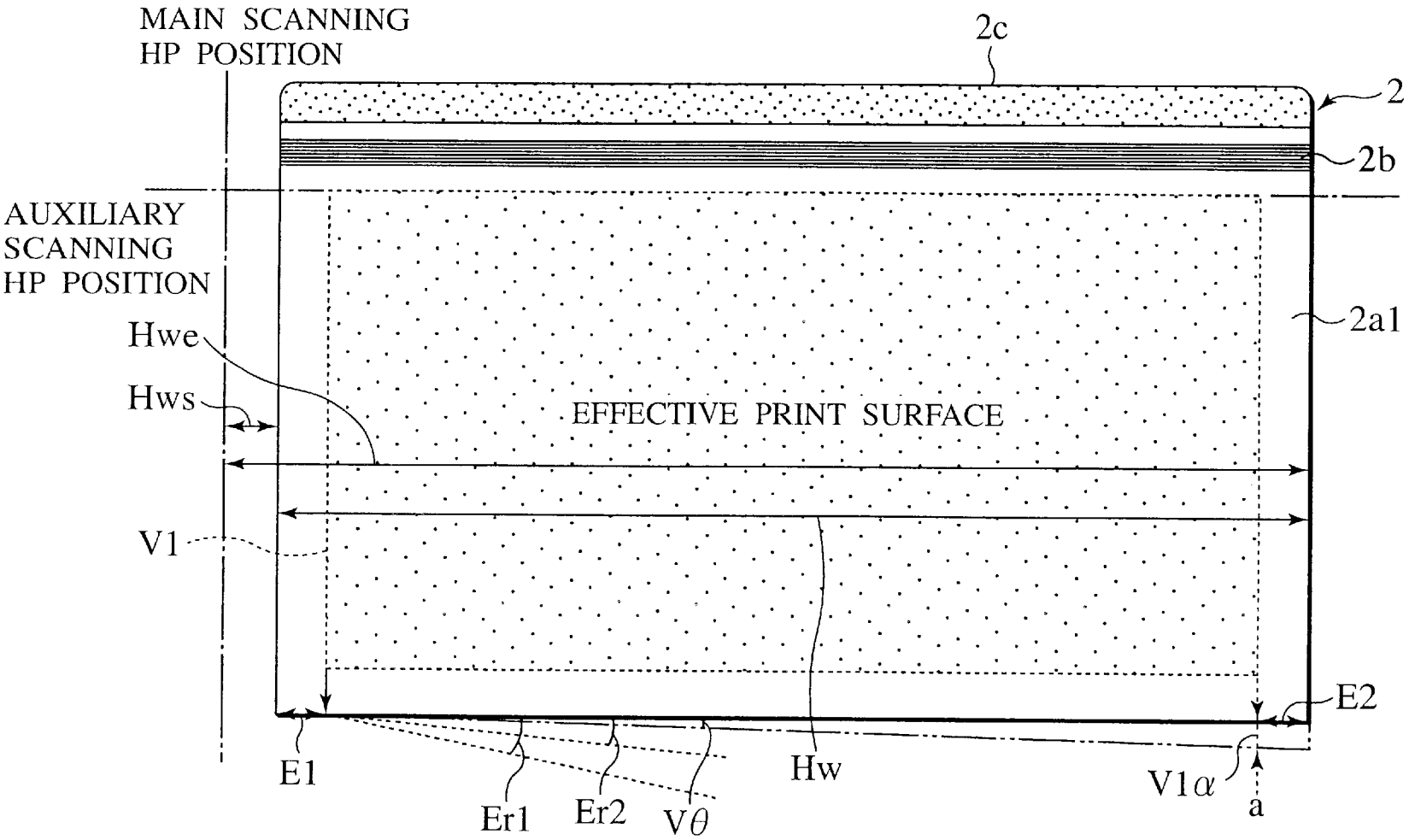
FIG. 5 is a view illustrating how the size and inclination of a sheet is detected in the printing machine of the first preferred embodiment according to the present invention.
Figure 6:
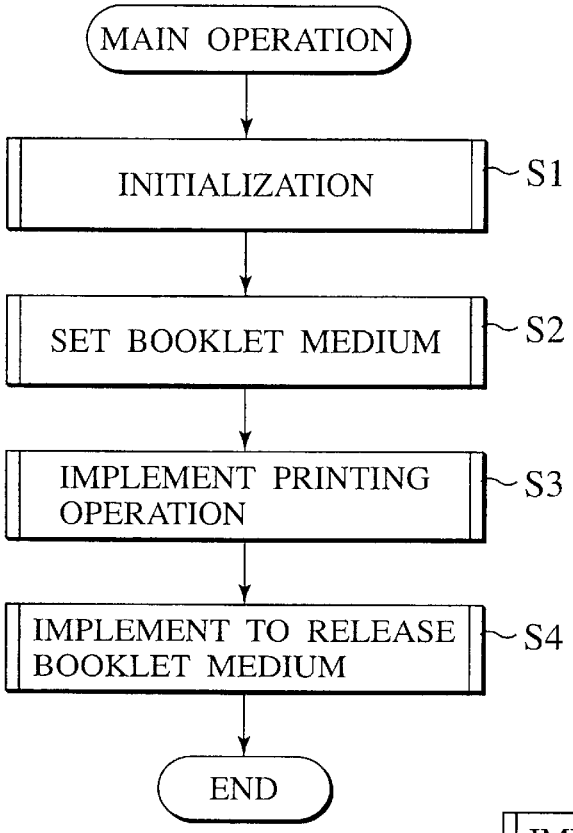
FIG. 6 is a flow chart illustrating the basic sequence of operation of the printing machine of the first preferred embodiment according to the present invention.
Figure 7:
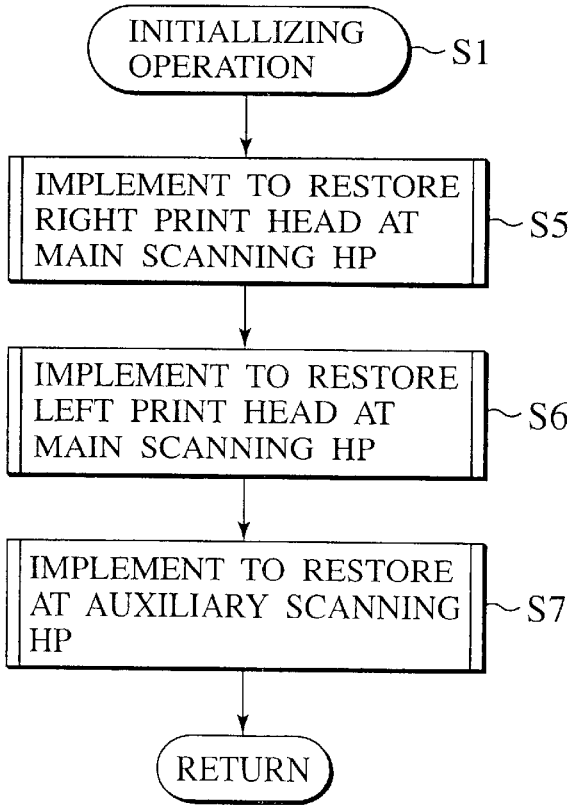
FIG. 7 is a flow chart illustrating initializing operation of the printing machine of the first preferred embodiment according to the present invention.
Figure 8:
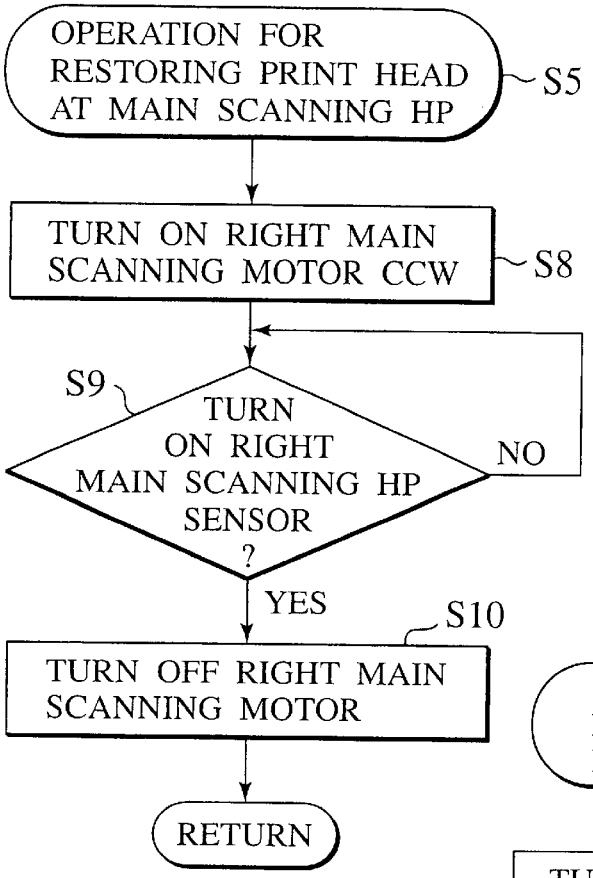
FIG. 8 is a flow chart illustrating main scanning home-position restoring operation of a right print head (a right head unit) of the printing machine of the first preferred embodiment according to the present invention.
Figure 9:
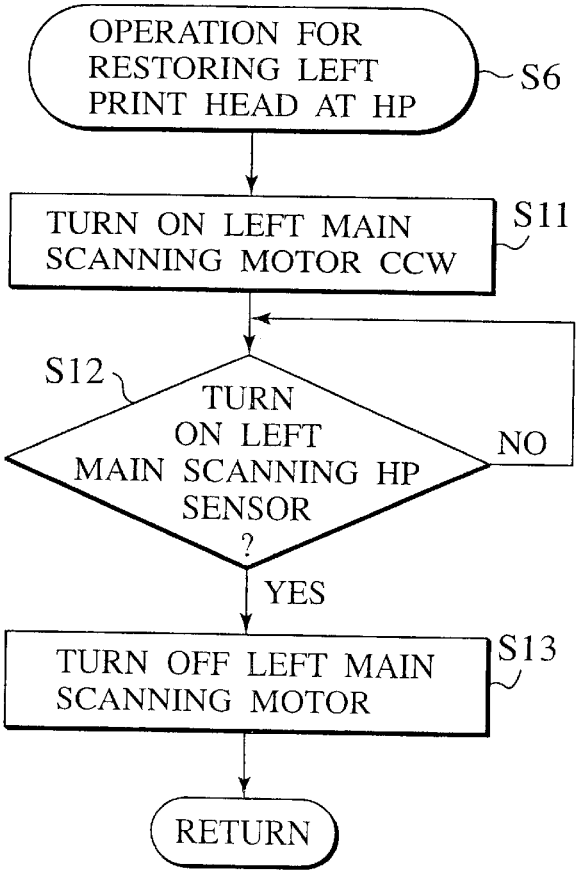
FIG. 9 is a flow chart illustrating main scanning home-position restoring operation of a left print head (a left head unit) of the printing machine of the first preferred embodiment according to the present invention.
Figure 10:
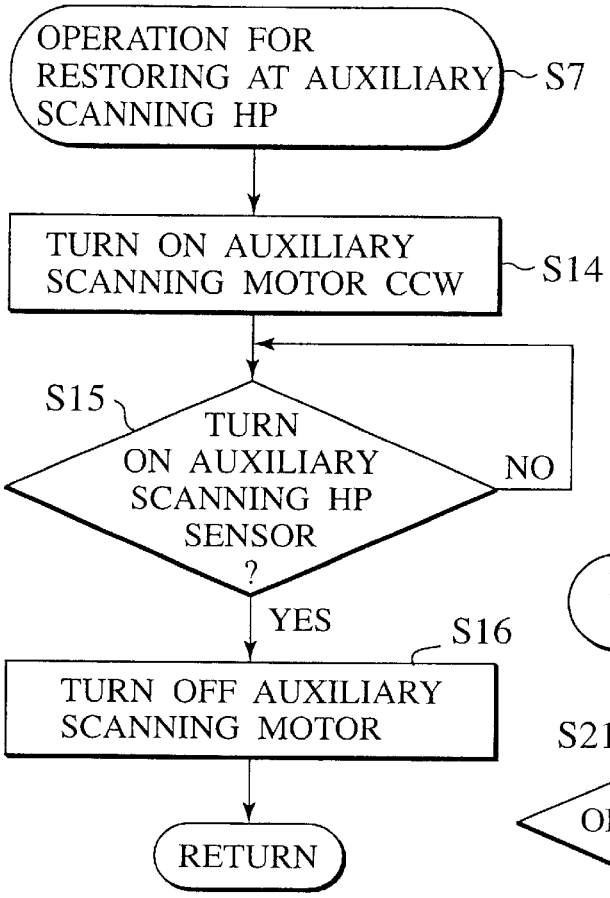
FIG. 10 is a flow chart illustrating auxiliary scanning home-position restoring operation of the printing machine of the first preferred embodiment according to the present invention.
Figure 11:
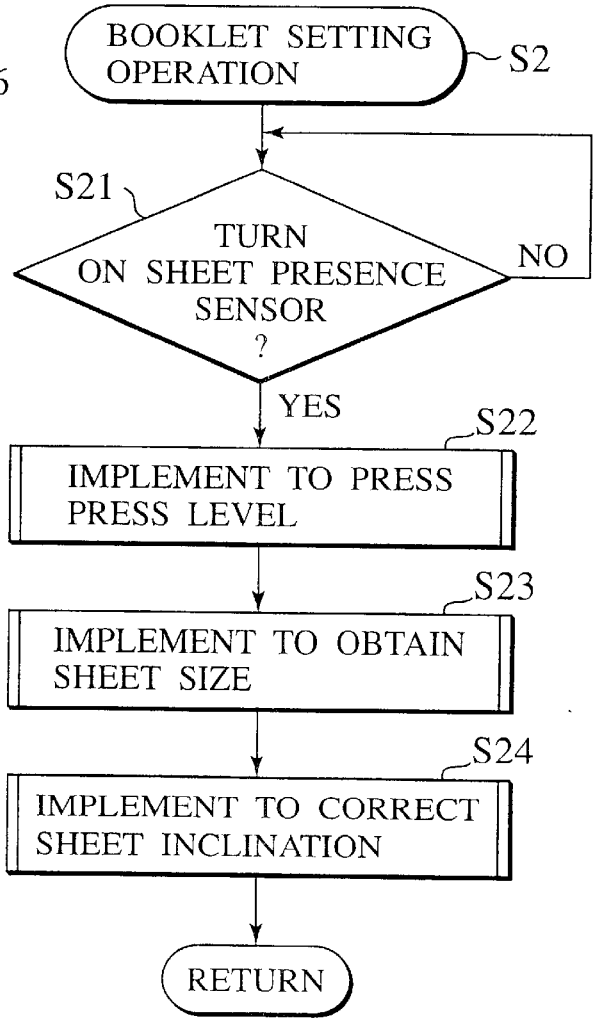
FIG. 11 is a flow chart illustrating setting operation of booklet-like medium of the printing machine of the first preferred embodiment according to the present invention.
Figure 12:
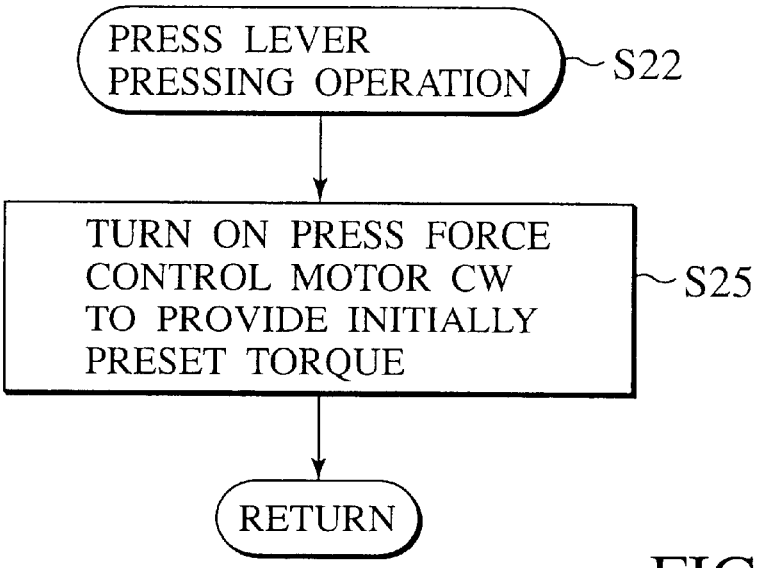
FIG. 12 is a flow chart illustrating pressing operation of a press lever of the printing machine of the first preferred embodiment according to the present invention.
Figure 13:
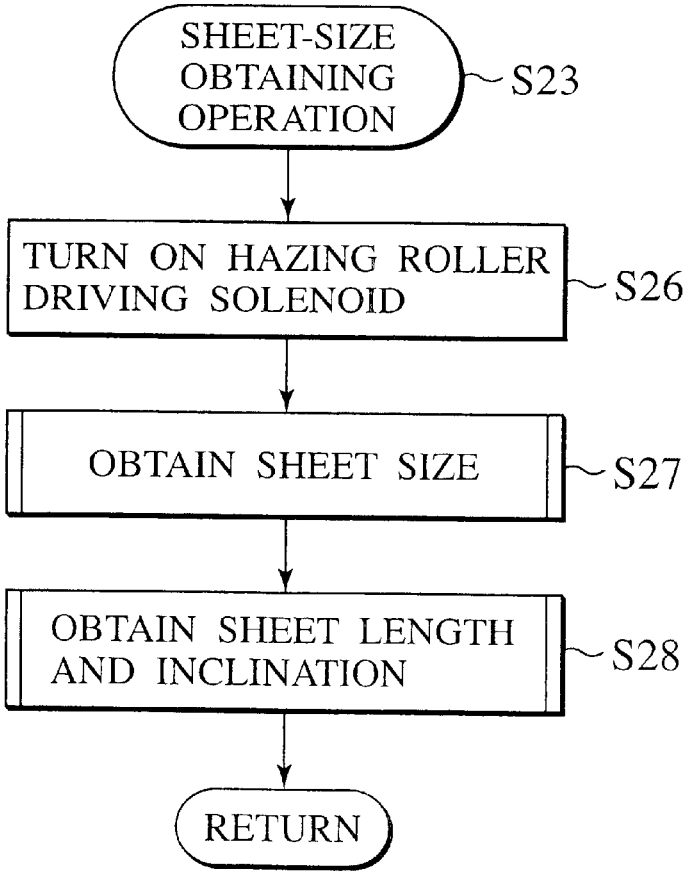
FIG. 13 is a flow chart illustrating sheet-size obtaining operation of booklet-like medium of the printing machine of the first preferred embodiment according to the present invention.
Figure 14:
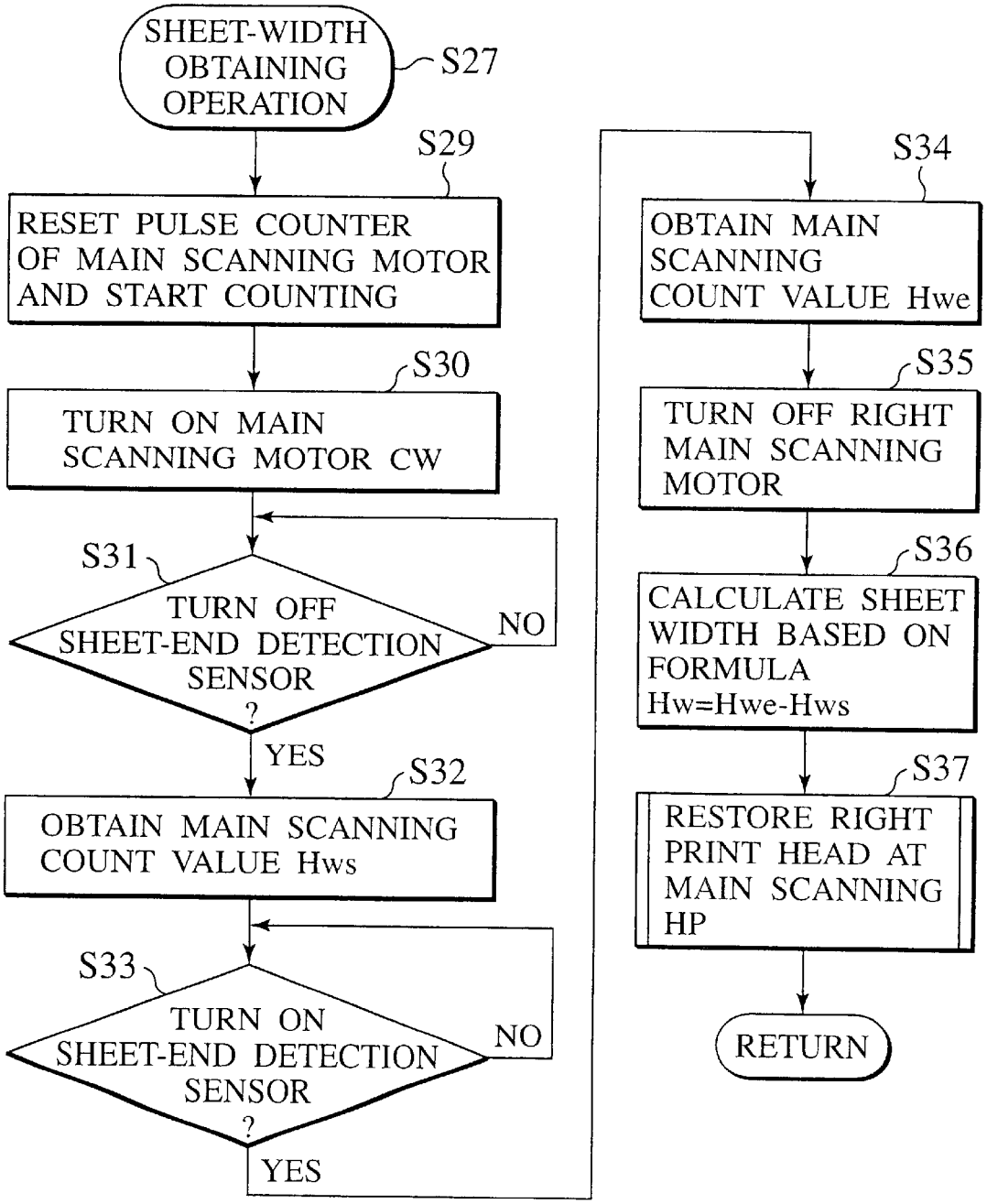
FIG. 14 is a flow chart illustrating sheet-width obtaining operation of the printing machine of the first preferred embodiment according to the present invention.
Figure 15:
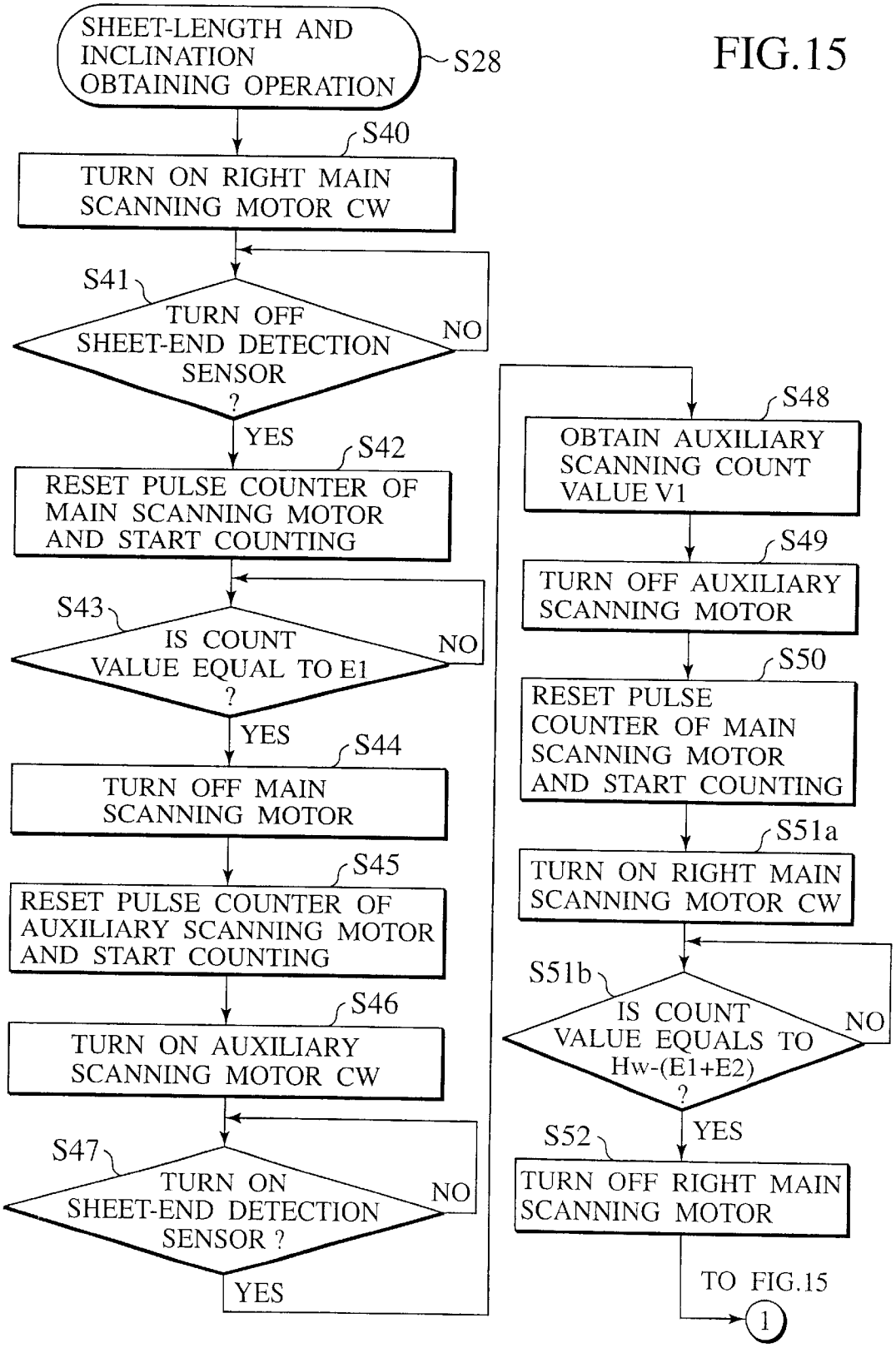
FIG. 15 is a flow chart illustrating a first half of sheet-length and sheet-inclination obtaining operation of the printing machine of the first preferred embodiment according to the present invention.
Figure 16:
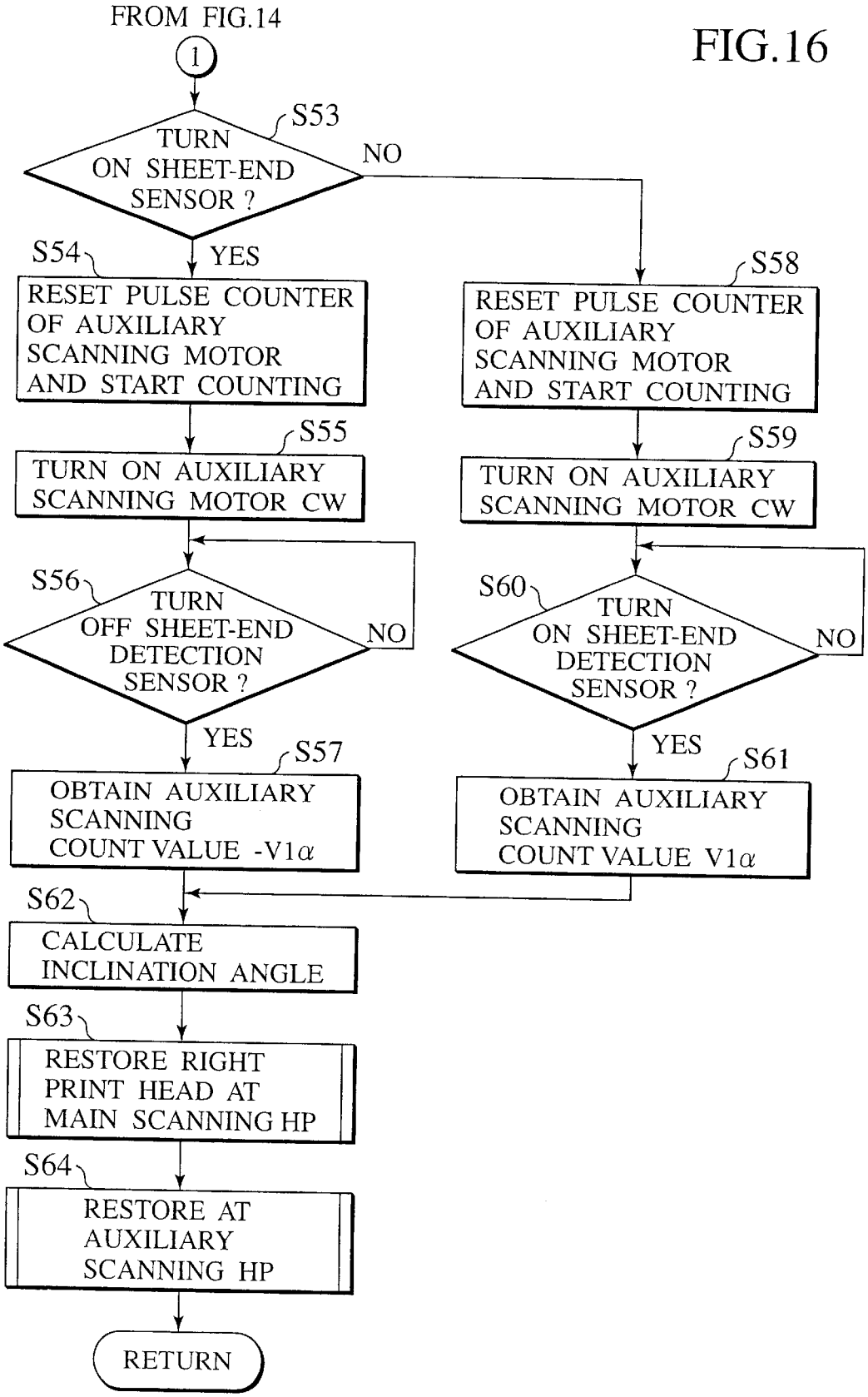
FIG. 16 is a flow chart illustrating a latter half of sheet-length and sheet-inclination obtaining operation of the printing machine of the first preferred embodiment according to the present invention.
Figure 17:
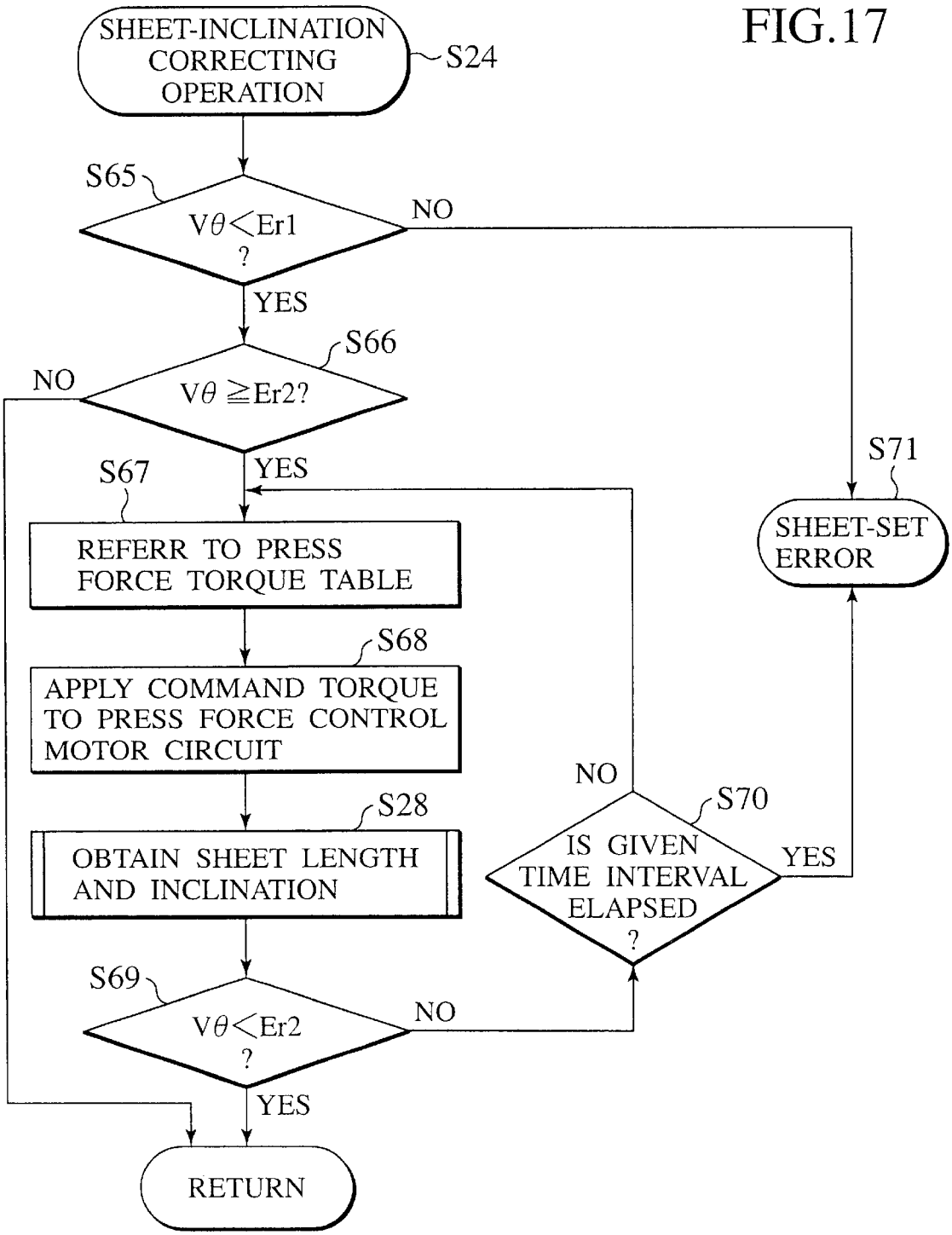
FIG. 17 is a flow chart illustrating sheet-set inclination correcting operation of the printing machine of the first preferred embodiment according to the present invention.
Figure 18:
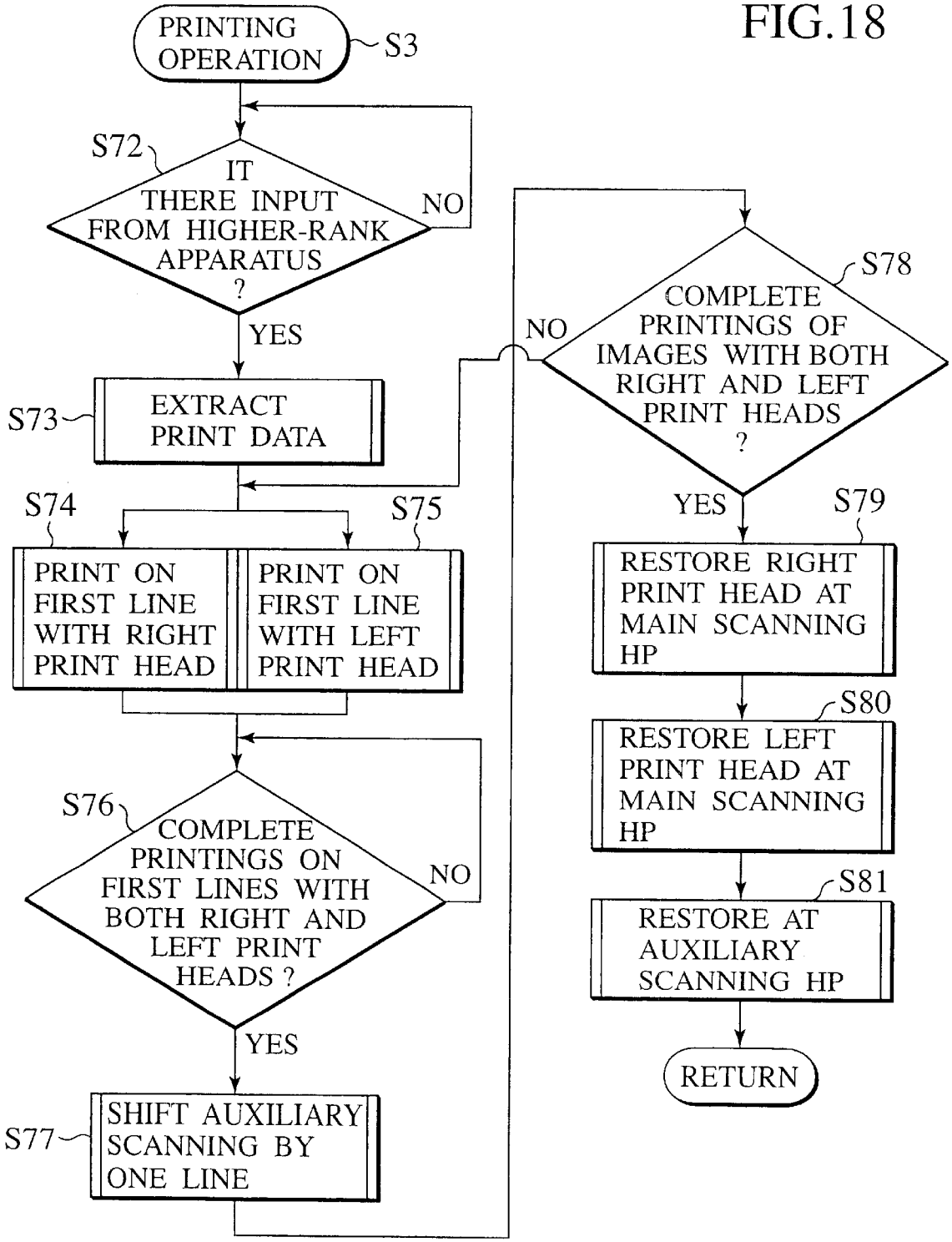
FIG. 18 is a flow chart illustrating printing operation of the printing machine of the first preferred embodiment according to the present invention.
Figure 19:
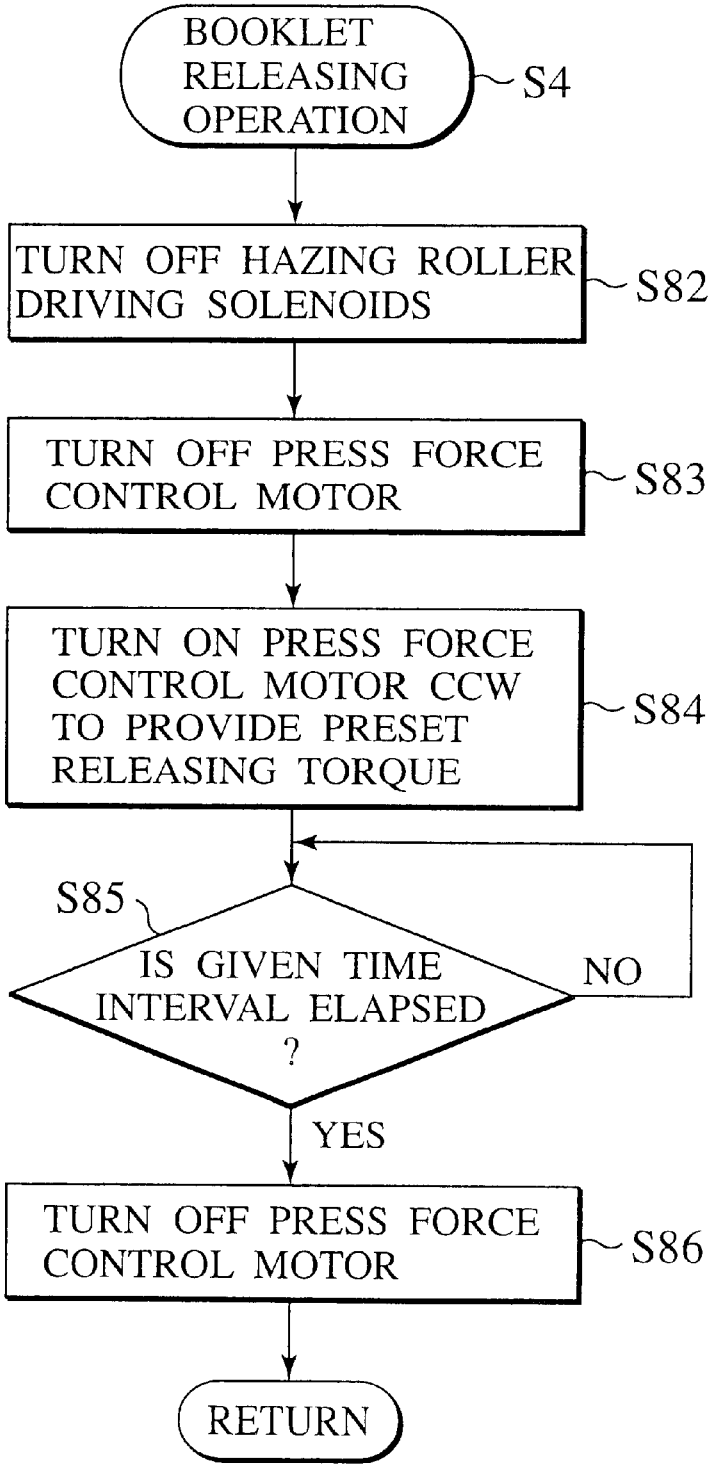
FIG. 19 is a flow chart illustrating booklet-like medium releasing operation of the printing machine of the first preferred embodiment according to the present invention.

FIGS. 2 to 19 shows a booklet-like medium printing machine of a first preferred embodiment according to the present invention, wherein FIG. 2 is a schematic view of the printing machine as viewed from a front side, FIG. 3 is a schematic structural view of the printing machine as viewed from a side thereof, FIG. 4 is a block diagram of a schematic circuit of the printing machine, FIG. 5 is a view illustrating how to detect the size of a sheet and an inclination thereof, FIG. 6 is a flow chart of an overall system of the printing machine, FIG. 7 is a flow chart for an initializing operation, FIG. 8 is a flow chart of a main scanning home-position restoring operation of a right printing head section, FIG. 9 is a flow chart of a main scanning home-position restoring operation of a left printing head section, FIG. 10 is a flow chart of an auxiliary scanning home-position restoring operation, FIG. 11 is a flow chart of a setting operation of a booklet medium, FIG. 12 is a flow chart of a pressurizing operation of a press lever, FIG. 13 is a flow chart of an obtaining process for a sheet-size, FIG. 14 is a flow chart of a sheet-width obtaining operation, FIG. 15 is a flow chart of a first half of an obtaining operation for the length and the inclination of the sheet, FIG. 16 is a flow chart of a latter half of an obtaining operation for the length and the inclination of the sheet, FIG. 17 is a flow chart of an operation for correcting an obliquely set sheet position, FIG. 18 is a flow chart of a printing operation, and FIG. 19 is a flow chart of a booklet-like medium releasing operation.

As shown in FIGS. 2 and 3, the printing machine 1, for booklet-like medium 2, of a double-side print type is arranged to perform a printing operation of a desired sheet 2*a*1 of booklet-like medium 2 such as a pocketbook, a diary and a book each of which has a plurality of sheets (paper sheets, etc) 2*a* that are bound at a bound portion 2*b,* with a frame body 3 having an upper wall formed with a horizontally aligned booklet resting surface 4. Formed at a substantially center of the booklet resting surface 4 in a lateral direction is a sheet insertion passage 5 which is open and which has a width sufficient for allowing the thickest volume of sheets 2*a,* to be used in booklet-like medium 2, to be adequately inserted. And, the machine body 3 is divided into right and left part receiver compartments 6*a, 6b* with respect to a boundary of the sheet insertion passage 5.

As seen in FIGS. 2 and 3, further, the printing machine 1 for booklet-like medium 2 of the double-sided print type is comprised of a booklet press unit 10 for pressing booklet-like medium 2, whose sheet 2*a*1 of a print page to be printed, toward the booklet resting surface 4, a print page positioning unit 40 for positioning the sheet 2*a*1 of the print page to be printed, which has been inserted through the sheet insertion passage 5, at a given print position, and a print head section 18 for printing both sheets 2*a, 2a* of the print page to be printed which is positioned by the print page positioning unit 40.

As seen in FIG. 2, the booklet press unit 10 is comprised of a press force control motor 11 mounted in the right part receiver compartment 6*a,* an arm 13 supported at an upper area of the machine body 3 via a first rotary member 12 and extending in an area above the booklet medium resting surface 4 of the machine body 3, and a press lever 15 connected to a distal end of the arm 13 via a second rotary member 14 and having a distal end portion provided with a press pad 16. And, upon rotation of the press force control motor 11, the press lever 15 is shifted between a wait position wherein the press pad is kept upward away from a backbone 2*c* of the booklet-like medium 2 and a press position wherein the press pad presses the backbone 2*c* of booklet-like medium 2 toward the booklet resting position 4.

The press force control motor 11 is comprised of a DC motor which is enabled to provide a desired torque control with a CPU 58 shown in FIG. 4. Interposed in the first rotary member 12 is a torque limiter, which is not shown, that is arranged to preclude a rotational torque of more than given value from being transferred from the press lever 15 to the press force control motor 11 while precluding a rotational torque of more than given value from being transferred from the press force control motor 11 to the press lever 15. Such an arrangement is effective for preventing the booklet medium 2 from being damaged and also for precluding the press lever 15, the arm 13 and the press force control motor 11 from being damaged.

Interposed in the second rotary member 14 is a rotation-lock unit, which is not shown, that is normally kept in a locked condition. Upon releasing this locked condition, it is possible for a rotational angle between the arm 13 and the press lever 15 to be freely varied to allow an angle of the press lever 15 to be freely adjusted. Also, in the first preferred embodiment, the booklet press unit 10 serves as a sheet oblique-position correction unit.

As shown in FIG. 2, the print head section 18 includes a pair of right and left head units 20*a, 20b* which includes print heads 19*a, 19b,* respectively, with the respective head units 20*a, 20b* being located in the right and left part receiver compartments 6*a, 6b*. The right and left head unit 20*a, 20b* is comprised of right and left vertically movable blocks 22*a, 22b* which are guided with right and left guide rods 21*a, 21b* which stand upright in the respective right and left part receiver compartments 6*a, 6b,* with the right and left vertically movable blocks 22*a, 22b* being moved in synchronism with one another by an auxiliary scanning direction drive unit 23.

The auxiliary scanning direction drive unit 23 is comprised of an auxiliary scanning motor 24 fixedly mounted to the frame body 3 in the right part receiver compartment 6*a* thereof, a pulley 7 fixed to a rotary shaft of the auxiliary scanning motor 24, a timing belt 8 having one side engaging the pulley 7, a pulley 9 which engages the other side of the timing belt 8, a lower pulley 25 fixed to the pulley 9 on the same axis, an upper pulley 26 located above the lower pulley 25 and rotatably supported with the machine body 3, a right timing belt 27 extending between the upper pulley 26 and the lower pulley 25, a left interlocking pulley 29 disposed in the left part receiver compartment 6*b,* an interlocking timing belt 30 extending between the left interlocking pulley 29 and a right interlocking pulley 28, a lower pulley 31 fixed to the left interlocking pulley 29 on the same axis, an upper pulley 32 rotatably supported with the frame body 3 at a position above the lower pulley 31, and a left timing pulley 33 extending between the upper pulley 32 and the lower pulley 31, with the right and left vertically movable blocks 22*a, 22b* being fixed to the right and left timing pulleys 27, 33, respectively.

And, when the auxiliary scanning motor 24 is driven, the left timing belt 33 is moved in synchronism with the right timing belt 27 and the interlocking timing belt 30, causing the vertically movable blocks 22*a, 22b* to be moved in synchronism with one another in an auxiliary scanning direction (in a vertical direction) A2. The auxiliary scanning motor 24 includes a stepping motor, with a CPU 58 shown in FIG. 4 being enabled to produce output signals with number of given pulses to be applied to the auxiliary scanning motor 24 for thereby controlling the moving distances and the positions of the vertically movable blocks 22*a, 22b*.

Further, the right and left vertically movable blocks 22*a, 22b* carry respective horizontal guide rods 34*a, 34b,* by which the print heads 19*a, 19b* are guided and supported, respectively.

These print heads 19*a, 19b* are moved with the respective main scanning drive units 35*a, 35b* in an asynchronous fashion.

As shown in FIGS. 2 and 3, the respective main scanning direction drive units 35*a, 35b* are comprised of main scanning motors 36*a, 36b* fixed to the vertically movable blocks 22*a, 22b,* one pulleys 37*a* (with only a reference numeral being given at one of the pulleys in the main scanning direction drive unit 35*a* for a convenience of illustration) connected to rotary shafts of the main scanning motors 36*a, 36b,* the other pulleys 38*a* rotatably supported with the vertically movable blocks 22*a, 22b* at positions spaced from the one pulleys 37*a* in a horizontal direction, and horizontal timing belts 39*a* extending between the other pulleys 38*a* and the one pulleys 37*a,* respectively, with the print heads 19*a,* 19*b* being fixedly secured to the respective timing belts 39*a.* And, when the respective main scanning motors 36*a,* 36*b* are driven, the respective horizontal timing belts 39*a* are moved, respectively, thereby causing the right and left print heads 19*a,* 19*b* to be moved in the asynchronous relationship in a main scanning direction (a horizontal direction) A1. The respective scanning motors 36*a,* 36*b* are comprised of stepping motors, with the CPU 58 shown in FIG. 4 being enabled to produce output signals with respective numbers of given pulses to be applied to the main scanning motors 36*a,* 36*b* for thereby controlling the moving distances and the positions of the respective print heads 19*a,* 19*b.*

The right and left print heads 19*a,* 19*b* are comprised of head holders which are not shown, piezo-type ink jet heads having ink tanks detachably mounted to the respective head holders or thermal-type ink jet heads, with the ink jet heads being replaceable and being enabled to inject ink to a sheet 2*a* to perform printing operation in a non-contact relationship.

As seen in FIG. 3, the print page positioning unit 40 includes a pair of hazing roller driving solenoids 41*a,* 41*b* which are fixedly supported with the right and left vertically movable blocks 22*a,* 22*b,* respectively, and a pair of sheet hazing rollers 42*a,* 42*b* which are driven with the respective hazing roller driving solenoids 41*a,* 41*b* and serve as a pair of sheet press members. The pair of sheet hazing rollers 42*a,* 42*b* are located in the right and left same vertical positions in the vicinity of an upstream side of auxiliary scanning directions A2 of the print heads 19*a,* 19*b* during printing operation. During turned on states of the pair of hazing roller driving solenoids 41*a,* 41*b,* the pair of sheet hazing rollers 42*a,* 42*b* protrude in the sheet insertion passage 5 to assume press positions as indicated by solid lines shown in FIG. 2. During turned off states, on the contrary, the pair of sheet hazing rollers 42*a,* 42*b* are retracted to assume wait positions as indicated by phantom lines shown in FIG. 2. And, The pair of sheet hazing rollers 42*a,* 42*b* are arranged to sandwich the sheet 2*a*1 at a position in the vicinity of the upstream side of the auxiliary scanning directions of the print heads 19*a,* 19*b* during printing operation. Further, due to the sheet being sandwiched between and positioned by the pair of hazing rollers 42*a,* 42*b,* the sheet 2*a*1 is preset to respective optimum printing positions with respect to the respective print heads 19*a,* 19*b.*

As shown in FIG. 3, a sheet size detection unit 43 is arranged to detect the size of the sheet 2*a*1 that is inserted through the sheet insertion passage 5 and is comprised of a sheet-end detecting sensor 44 fixed to the right print head 19*a,* a counter, which is not shown, for suitably counting the number of revolutions of the main scanning motor 36*a* and the auxiliary scanning motor 24, and a calculating section, which is not shown, for implementing given calculation base on a resulted count value of the counter. The sheet-end detecting sensor 44 may, for example, include a reflection type photosensor that produces an OFF signal upon detected condition of the sheet 2*a*1 and an ON signal upon non-detected condition of the sheet 2*a*1. A control system is in charge of the counter and the calculating section as will be described later in detail.

As seen in FIG. 3, a sheet-inclination detecting unit 45 is arranged to detect the inclination of the sheet 2*a*1 that is inserted though the sheet insertion passage, and is comprised of, like the sheet size detecting unit 43, the sheet-end detecting sensor 44 fixed to the right print head 19*a,* the counter, which is not shown, for suitably counting the number of revolutions of the main scanning motor 36*a* and the auxiliary scanning motor 24, and the calculating section, which is not shown, for implementing given calculation base on the resulted count value of the counter. The sheet-end detecting unit 44 forms a part of the sheet-size detecting unit 43. The control system is in charge of the counter and the calculating section as will be described later in detail.

As shown in FIG. 2, right and left main scanning home-position sensors 46*a,* 46*b* are located on the right and left vertically movable blocks 22*a,* 22*b,* respectively, for detecting whether the respective print heads 19*a,* 19*b* assume main scanning home positions. In particular, the respective main scanning home-position sensors 46*a,* 46*b,* and a comprised of a light-interruptive type photosensor that allows photo-interruptive plates 47*a* (with only photo-interruptive plate located at the print head 19*a* being shown in FIG. 3) to interrupt beams of detection light to cause the sensors to produce the ON signals for thereby detecting the main scanning home-position. The main scanning home-position (HP) is settled to assume a position outside the maximum size of the sheet 2*a*1 that is inserted through the sheet insertion passage 5 as viewed in FIG. 5.

As shown in FIGS. 2 and 3, auxiliary scanning home-position sensors 48 are mounted in the frame body 3 to detect whether the vertically movable blocks 22*a,* 22*b,* i.e. the print heads 19*a,* 19*b* assume the respective auxiliary scanning home-positions or are out of these respective positions. In particular, each of the auxiliary home-position sensors 48 is comprised of a light interruptive type photosensor that is arranged to produce the ON signal, when the photo interruptive plate 49 mounted to the right vertically movable block 22*a* and shown in FIG. 3 interrupts the beam of detection light, for thereby enabling detection of the auxiliary scanning home-position.

As viewed in FIGS. 2 and 3, a booklet presence sensor 50 is mounted in the machine body 3 and detects whether booklet-like medium 2 is placed over the booklet resting surface 4 or is out of the same. In addition, a control unit 51 is mounted in the right part receiver compartment 6*a,* while a power supply unit 52 is received in the left part receiver compartment 6*b.* The power supply unit 52 is arranged to supply electric power to various electronic component parts, with the structure of the control unit 51 being described below in detail.

Now, a control system for the printing machine 1 is described. As shown in FIG. 4, the control unit 51 incorporates therein a motor drive circuit 55, an image processor circuit 56, a memory 57 and the CPU (a Central Peripheral Unit) 58, etc. The motor drive circuit 55 is responsive to control signals delivered from the CPU 58 to produce drive signals to various motors. The image processor circuit 56 implements operations such as converting image data, supplied from an external higher rank apparatus 59 such as a personal computer, into print data, thereby allowing the print heads 19*a,* 19*b* to be driven on the basis of print data produced by the image processor circuit 56. Such a control is carried out with the CPU 58. The memory 57 stores therein programs for implementing the flow charts shown in FIGS. 6 to 19 and stores various data such as press torque tables, etc.

Further, the CPU 58 is able to control read-out or write-in operations and is arranged to receive sensor outputs produced from the sheet-end detection sensor 44, the right and left main scanning home-position sensors 46*a,* 46*b,* the auxiliary scanning home-position sensor 48 and the booklet presence sensor 50. Thus, the CPU 58 serves to control the press force control motor 11, the auxiliary scanning motor 24 and the right and left main scanning motors 36*a,* 36*b* by means of the motor drive circuit 56 to carry out the flow charts shown in FIGS. 6 to 19, to control the drives of the right and left hazing roller driving solenoids 41*a,* 41*b* and to control the drives of the right and left print heads 20*a,* 20*b.* A detailed process of such a control is described below.

Now, the printing operation of the printing machine 1 is described in conjunction with the flow charts of FIGS. 6 to 19. It is to be noted here that, during clockwise (CW) rotations of the main scanning motors 36*a,* 36*b,* the right and left print heads 19*a,* 19*b* are caused to move in directions away from the main scanning home-positions whereas, during counter-clockwise (CCW) rotations of the motors 36*a,* 36*b,* the print heads 19*a,* 19*b* are caused to move toward the main scanning home-positions. It is also supposed that, during clockwise (CW) rotation of the auxiliary scanning motor 24, the right and left print head units 20*a,* 20*b,* i.e. the right and left print heads 19*a,* 19*b* are caused to move in a direction (downward direction) away from the auxiliary scanning home-position whereas, during counter-clockwise (CCW) rotation of the motor 24, the right and left print head units 20*a,* 20*b,* i.e. the print heads 19*a,* 19*b* are caused to move toward the auxiliary scanning home-position. It is to be further noted that, during clockwise (CW) rotation of the press force control motor 11, the press lever 15 is caused to move from the wait position to the press position whereas, during counter-clockwise (CCW) rotation of the motor 11, the press lever 15 is caused to move from the press position to the wait position.

An operator unfolds booklet-like medium 2 in both sides such that the bound portion 2*b* assumes the center of the boundary of the desired sheet 2*a*1 to be printed, with only the desired sheet 2*a*1 to be printed being inserted through the sheet insertion passage 5 while placing booklet-like medium 2 on the booklet resting surface 4. And, print data, etc. is specified and selecting print start command allows printing operation to be carried out.

First, a whole concept in operation of the printing operation involves an initializing operation (in Step S1) and, subsequently, a booklet setting operation is carried out to set booklet-like medium 2 placed on the booklet resting position 4 (in Step S2). Successively, the printing operation is carried out to print on the sheet 2*a*1 of the booklet-like medium 2 (in step S3). Finally, booklet releasing operation is implemented to allow booklet-like medium 2, which has been placed on the booklet resting surface 4, to be released (in step S4). Hereinafter, respective operating steps are described in sequence.

As shown in FIG. 7, in the initializing operation (step S1), restoring steps are implemented to restore the right and left print heads 19*a,* 19*b* at the respective main scanning home-positions (in steps S5 and S6) and restoring operation is implemented to restore the right and left print heads 19*a,* 19*b* at the auxiliary scanning home-position (in step S7).

More particularly, the right main scanning motor 36*a* is reversed (in step S8) and operation is performed to check the change-over timing between the turning-on and turning-off of the main scanning home-position sensor 46*a* (in step S9). And, when the beam of detection light of the main home-position sensor 46*a* is interrupted with the light interruptive plate 47*a* such that the output is switched over from the turned-off state to the turned-on state, the drive of the main scanning motor 46*a* is stopped (in step S10). Thus, the right print head 19*a* is restored at the main scanning home-position.

Next, the left main scanning motor 36*b* is reversed (in step S11) as shown in FIG. 9 and operation is performed to check the change-over timing between the turning-on and turning-off of the main scanning home-position sensor 46*b* (in step S12). And, when the beam of detection light of the main home-position sensor 46*b* is interrupted with the light interruptive plate, which is not shown, such that, when the output is switched over from the turned-off state to the turned-on state, the drive of the main scanning motor 46*b* is stopped (in step S13). Thus, the left print head 19*b* is restored at the main scanning home-position.

Finally, as shown in FIG. 10, the auxiliary scanning motor 24 is reversed (in step S14) and operation is performed to check the change-over timing between the turning-on and turning-off of the auxiliary scanning home-position sensor 48 (in step S15). And, when the beam of detection light of the main scanning home-position sensor 48 is interrupted with the light interruptive plate 49 such that, when the output is switched over from the turned-off state to the turned-on state, the drive of the auxiliary scanning motor 24 is stopped (in step S16). Thus, the right and left print heads 19*a,* 19*b* are restored at the main scanning home-positions.

As shown in FIG. 11, the booklet setting operation (step S2) involves the steps of checking the output of the booklet presence sensor 50 (in step S21), pressing the press lever (in step S22) in the presence of the booklet-like medium 2, obtaining the sheet size (in step S23) and correcting the sheet inclination (in step S24). In particular, as shown in FIG. 12, the press lever pressing step (step S22) includes the step of driving the press force control motor 11 clockwise at an initially preset torque (in step S25). Then, the press lever 15 is moved downward from its wait position to compel the press pad 16 to be shifted into the press position wherein the backbone 2*c* of the booklet-like medium 2 is pressurized. The press force control motor 11 is continuously turned on to be driven at the initially preset torque, thereby causing the booklet-like medium 2 to be pressed against the booklet resting surface 4 with the press force of such an initially preset torque.

As shown in FIG. 13, the sheet size obtaining operation (step S23) includes the steps of turning on the right and left hazing roller driving solenoids 41*a,* 41*b* (in step S26), obtaining the sheet width (in step S27) and obtaining the sheet length and inclination (in step S28) under a condition where the desired sheet 2*a*1 is sandwiched between the right and left hazing roller driving rollers 42*a,* 42*b.*

As shown in FIG. 14, the sheet width obtaining operation (step S27) includes the steps of resetting the pulse counter of the main scanning motor 36*a* to set the pulse counter in its start condition (in step S29) and driving the main scanning motor 36*a* clockwise (in step S30). And, operation is carried out for checking the output of the sheet-end detection sensor 44. In this instance, when the output of the sheet-end detection sensor 44 is changed over from the turned-on state to the turned-off state (in step S31), operation is implemented to obtain the count value Hws of the pulse counter of the main scanning motor 36*a* (in step S32). In next step, the output of the sheet-end detection sensor 44 is continuously monitored and, when the output of the sheet-end detection sensor 44 is changed over from the turned-off state to the turned-on state (in step S33), the count value Hwe of the pulse counter of the main scanning motor 36*a* is obtained (in step S34) and thus the main scanning motor 36*a* is turned off (in step S35). That is, as shown in FIG. 5, the count value Hws represents a value indicative of a distance between the main scanning home-position and a proximity edge of the sheet 2*a*1, and the count value Hwe represents a value indicative of a distance between the main scanning home-position and a remotest edge of the sheet 2*a*1

In next step, computation is implemented based on a formula of Hw=Hwe−Hws to calculate the sheet width Hw (in step S36). And, the right print head 19*a* is restored to the main scanning home-position to complete the operation (in step S37).

As shown in FIGS. 15 and 16, the sheet length and inclination obtaining operation (step S28) includes the steps of driving the main scanning motor 36*a* clockwise (in step S40) and monitoring the output of the sheet-end detection sensor 44. In this instance, when the output of the sheet-end detection sensor 44 is changed over from the turned-on state to the turned-off state (in step S41), the pulse counter of the main scanning motor 36*a* is reset, thereby setting the pulse counter in its counting condition to begin the counting operation (in step S42). And, when the count value equals a value of E1 (which is an arbitrary constant), the main scanning motor 36*a* is turned off (in step S44). Next, the pulse counter of the auxiliary scanning motor 24 is reset to render the counter to remain in the start condition (in step S45), and the auxiliary scanning motor 24 is driven clockwise (in step S46). And, the output of the sheet-end detection sensor 44 is monitored. In this instance, when the output of the sheet-end detection sensor 44 is changed over from the turned-off state to the turned-on state (in step S47), the count value V1 of the pulse counter of the auxiliary scanning motor 24 is obtained (in step S49).

Next, as shown in FIG. 15, the pulse counter of the main scanning motor 36*a* is reset to render this counter in its start condition (in step S50), and the main scanning motor 36*a* is driven clockwise (in step S51*a*). And, when the count value equals Hw−(E1+E2) (wherein E2 is an arbitrary constant) (in step S51*b*), the main scanning motor 36*a* is turned off (in step S52). That is, the position where the count value equals Hw−(E1+E2) is plotted at point a in FIG. 5 that corresponds to the edge of the sheet 2*a*1 in the absence of the inclination of the sheet 2*a*1 with respect to the main scanning direction A1 of the print head 19*a* and that corresponds to a position to allow the sheet 2*a*1 to be shifted outward (at a position shown in FIG. 5) or inward in the presence of the inclination of the sheet 2*a*1.

Subsequently, as shown in FIG. 16, the output of the sheet-end detection sensor 44 is checked (in step S53) and, if the output of the sheet-end detection sensor 44 is ON, i.e. if the sheet-end detection sensor 44 is shifted to the position (shown in FIG. 5) outside the sheet 2*a*1, the pulse counter of the auxiliary scanning motor 24 is reset, rendering this counter in its start condition (in step S54) while driving the auxiliary scanning motor 24 counter-clockwise to allow the print heads 19*a,* 19*b* to raise upward (in step S55). And, the output of the sheet-end detection sensor 44 is monitored and, when the output of the sheet-end detection sensor 44 is changed over from the turned-on state to the turned-off state (in step S56), the count value of −V1α of the pulse counter of the auxiliary scanning motor 24 is obtained (in step S57).

Further, if the output of the sheet-end detection sensor 44 remains at the off level, i.e. if the sheet-end detection sensor 44 is located at the position that is shifted inward, as shown in FIG. 16, the pulse counter of the auxiliary scanning motor 24 is reset to render this counter to assume a start condition (in step S58) while driving the auxiliary scanning motor 24 clockwise to lower the print heads 19*a,* 19*b* (in step S59). And, when the output of the sheet-end detection sensor 44 is checked, if the output of the sheet-end detection sensor 44 is changed over from the turned-off state to the turned-on state (in step S60), the count value V1α of the pulse counter of the auxiliary scanning motor 24 is obtained (in step S61). That is, as shown in FIG. 5, the count values −V1α, V1α represent the values that correspond to the distances shifted to the edge of the sheet 2*a*1.

Subsequently, as shown in FIG. 16, operation is implemented to calculate the inclined angle of the sheet 2*a*1 according to a formula Vθ=tan−1(|V1α|/Hw) (in step S62). And, the right print head 19*a* is returned to the main scanning home-position (in step S63), while returning the right and left print heads 19*a,* 19*b* to the auxiliary scanning home-position to complete the operation (in step S64). Also, when it is desired to obtain the inclined angle Vθ in a more accurate manner, computation is carried out by substituting Hw for Hw−(E1+E2) in the above computation formula.

Next, as shown in FIG. 17, the sheet inclination correcting operation (step S24) includes the step of checking whether or not the inclined angle Vθ of the sheet 2*a*1 has a relationship Vθ<Er1 (wherein Er1 represents an improper printing angle) (in step S65). In the absence of relationship Vθ<Er1, that is, if the inclined angle Vθ exceeds an allowable correcting range, then, operation is implemented to carry out a sheet-set error correction (in step S71). The sheet-set error correction involves a step of providing a display of such an operation to compel the operator to correctly set the booklet-like medium 2. If Vθ<Er1, i.e. if the inclined angle of the sheet 2*a*1 remains in the correctable range even in the worst case, operation is carried out to check whether there exist the relation Vθ≧Er2 (wherein Er2 is a printable angle) (in step S66). If the inclined angle Vθ is less than Er2, then, the operation is terminated. If the inclined angle Vθ is greater than Er2, operation is implemented to obtain a command torque value (that corresponds to a torque value greater than the initially preset torque) which corresponds the inclined angle Vθ by referring to the press force torque table stored in the memory 57 (in step S67), thereby altering the number of revolutions of the press force control motor 11 to a value determined by the command torque (in step S68). Then, the booklet-like medium 2 is pressed with a further higher press force than before, thereby causing the sheet 2*a*1 of the booklet-like medium 2 to be normally shifted in a direction to correct the inclination. Here, the correlated data of the press force torque table is settled such that a larger torque is applied in proportion to the magnitude of the inclined angle.

As shown in FIG. 17, upon completion of the step for correcting the inclination of the sheet by the press lever 15, operation is performed again to implement the step of obtaining the sheet lengthwise inclination (step S28) and to check whether the inclined angle Vθ of the sheet 2*a*1 remains in the range of Er2 or is out of that range (in step S69). In case of the inclined angle Vθ having a value less than Er2, the operation is terminated. In case of the inclined angle Vθ having a value not less than Er2, the press lever 15 is operated to repeatedly perform the inclination connection, and, even with a given time period that has been elapsed, if the inclined angle Vθ is not decreased to a value below Er2, operation is implemented to perform the step of correcting the sheet-set error (in step S71). Upon repeated execution of the inclination correction using the press lever 15, if the inclined angle Vθ is lower than Er2, then the operation is terminated.

As shown in FIG. 18, the printing operation (step S3) includes the step of checking whether or not there is the input, involving image data, applied from the higher rank apparatus 59 (in step S72). And, in case of the presence of the input data such as image data etc., image data is extracted and converted into print data with the image processor circuit 56, with resulted print data being applied to respective driver circuits of the print heads 19*a,* 19*b* which in turn are operated to inject ink from the injections nozzles 17 to execute printings on respective first lines (in steps S74, S75).

And, upon terminations of both printings on the respective first lines with both the print heads 19*a,* 19*b,* the auxiliary scanning motor 24 is rotated at a given angle determined by the given number of pulses and shifted by one line in the auxiliary scanning direction (in step S77), thereby permitting the respective print heads 19*a,* 19*b* to implement printings on respective second is lines (in steps S74, S75). Upon termination of such a series of operations executed on whole lines, when the printings representative of one image are completed (in step S78), the right and left print heads 19*a,* 19*b* are returned to the main scanning home-positions (in steps S79, S80) and, simultaneously, the auxiliary scanning home-position is restored (in step S81) to complete the whole operation.

As shown in FIG. 19, the booklet releasing operation (step S4) includes the step of turning off the right and left hazing roller driving solenoids 41*a,* 41*b* (in step S82), allowing the pair of hazing rollers 42*a,* 42*b* to be shifted to their wait positions to release the sheet 2*a*1. Subsequently, the press force control motor 11 is turned off (in step S83) and, then, the press force control motor 11 is reversed with a preset given releasing torque for a given time interval whereupon the motor is stopped (in steps S84 to S86). As such, the press lever 15 is raised from its press position and assumes the wait position to allow the press lever to be shifted away from the backbone 2*c* of the booklet-like medium 2. Thus, it is possible for the operator to freely remove booklet-like medium 2 from the booklet resting surface 4. When it is desired for another new sheet 2*a*1 to be printed, the above operations may be repeatedly carried out.

With such a printing machine 1 for the booklet-like medium 2, there are conditions where different volumes of thickness are obtained in dependence on the number of sheets shared in right and left areas when booklet-like medium 2 is centrally unfolded in the bound portion 2*b* in double-sided conditions at a boundary line of the sheet 2*a*1 to be printed. The booklet-like medium 2, which is unfolded in the double sides, is pressed against the booklet resting surface 4 with the booklet pressing unit 10 while, at the same time, only a desired sheet 2*a*1 to be printed is inserted to the sheet insertion passage 5, with the inserted sheet 2*a*1 being positioned by the print page positioning unit 40. Thus, the sheet 2*a*1 can be printed with the print head section 18 under a condition where the sheet is positioned with the print page positioning unit 40 without being adversely affected with the thickness or the curved surfaces of the sheets 2*a* that are divided into the right and left areas when the booklet medium is centrally unfolded in the bound portion 2*b*. Consequently, it is possible for the sheet 2*a*1 of a particular page to be printed under an appropriate printing condition without causing the sheet to be printed from being formed with a curved surface regardless of the right and left volumes of the thickness.

Therefore, there is no need for various detection means for adjusting the print head section and the sheet for printing to be adjusted in a given correlated relationship, and adjusting means associated with these detection means as would required in the related art practice. More particularly, in an event that the sheets 2*a* which are bounded has a large number of pages and, also, the sheets 2*a* lack firmnesses, if the booklet medium is centrally unfolded in both sides at the bound portion 2*b,* the sheets 2*a* are formed with curved surfaces with large curvatures over an extended area. It is possible for such booklet-like medium 2 to be printed without totally forming the curved surfaces and, thus, it is effective to perform printing on such booklet-like medium 2.

Further, the presence of the print heads 19*a,* 19*b* located at both sides of the sheet 2*a*1 enables both surfaces of the sheet 2*a*1 to be simultaneously printed. Furthermore, since the booklet pressing unit 10 is arranged to press the backbone 2*c* of booklet-like medium 2 against the booklet resting surface 4, the press force of the booklet pressing unit 10 is directly applied to the bound portion 2*b* of booklet-like medium 2 in a direction to compel the same to become closer to the booklet resting surface 4 such that the bound portion 2*b* is rendered to be closer to the booklet resting surface 4 in an effective manner with a week press force. Accordingly, it is possible for the sheet 2*a*1 of the particular page for printing to be deeply inserted through the sheet insertion passage 5 with the week press force.

In addition, the print page positioning unit 40 includes the pair of sheet hazing rollers 42*a,* 42*b* that are moved in interlocking relationships with the movements of the pair of print heads 19*a,* 19*b* in the auxiliary scanning direction A2, with such a pair of sheet hazing rollers 42*a,* 42*b* serving to sandwich the sheet at the upstream portions of the print heads 19*a,* 19*b* in the auxiliary scanning direction A2 during the printing operation. As a result, since the sheet 2*a*1 is supported under pressure with the pair of sheet hazing rollers 42*a,* 42*b* at areas close proximity to the print positions of the print heads 19*a,* 19*b* and at the upstream sides of the auxiliary scanning direction A2 during the printing operation, the sheet can be reliably positioned at the areas where the printing is executed with the print heads 19*a,* 19*b* without causing the pair of sheet hazing rollers 42*a,* 42*b* to press the printed areas after the printing operations for thereby preventing ink of the print areas from spreading out.

Further, since the print heads 19*a,* 19*b* of the print head units 18 are located to be moveable, respectively, in directions to be perpendicular to a direction parallel to the longitudinal direction of the bound portion 2*b* of booklet-like medium 2, it is possible to carry out the printing operations in two-dimensional areas which the print heads 19*a,* 19*b* are rendered to scan and such print heads are suited for use as the print head units of the ink jet type which carries an ink tank. Furthermore, the presence of the sheet size detection unit 43 that detects the size of the sheet 2*a*1, of the particular page to be printed, which is inserted through the sheet insertion passage 5 enables the sheet of various sizes to be printed at a suitable printing areas. Also, it is possible to prevent errors such as ink to be coated over an area where the sheet 2*a*1 is not positioned and there is no opportunity for internal parts of the printing machine to be stained with ink.

In addition, the presence of the sheet inclination detection unit 45 that detects the inclination of the desired sheet 2*a*1, of the particular page to be printed, which is inserted through the sheet insertion passage 5 enables the inclination of the sheet 2*a*1, of the page to be printed, that is inserted through the sheet insertion passage 5 to be detected, thereby precluding the opportunity for the sheet 2*a*1 to be obliquely printed. Further, the presence of the booklet pressing unit 10 that serves as the sheet inclination correcting unit for correcting the inclined condition of the sheet 2*a*1, of the particular page to be printed, which is inserted through the sheet insertion passage 5 allows the booklet pressing unit 10, which serves as the sheet inclination correcting unit, to correct the inclined condition of the sheet 2*a*1, of the particular page to be printed, that is inserted through the sheet insertion passage 5 when the sheet inclination detecting unit 45 has detected the inclined condition of the sheet 2*a*1. Thus, when the sheet 2*a*1 remains in the inclined condition, the inclined condition of the sheet 2*a*1 is automatically corrected by the booklet pressing unit 10 which serves as the sheet inclination correcting unit. As a consequence, it is possible for the print sheet 2*a*1 from being obliquely printed with no need for the operator to carry out the inclination correcting operation of the sheet 2*a*1.

Further, when the sheet inclination detection unit 45 detects the inclined condition of the sheet, the booklet pressing unit 10 actuates to increase the magnitude of press force to be applied to booklet-like medium 2. As booklet-like medium 2 is strongly pressed against the resting surface 4, a particular area where the degree of proximity near the bound portion 2*b* is weak is pressed against and shifted toward the booklet resting surface 4, with a resultant correction in the inclined state of the sheet 2*a*1 of the page to be printed for thereby precluding the sheet from being obliquely printed. Furthermore, since the booklet pressing unit 10 also serves as the sheet inclination correcting unit, there is no need for providing a separate sheet inclination correcting unit, resulting in a decrease in the number of component parts and in simplified structure of the printing machine.

Also, since the pair of print heads 19*a,* 19*b* are comprised of the non-contact type ink jet heads, it is possible for the sheet 2*a*1 to be simultaneously printed at the same areas of both surfaces to obtain a high speed printing operation while enabling the print heads to be fed in the auxiliary scanning direction A2 in a single structure. On the contrary, in an event that the print head of the contact type is employed, there is a need for carrying out the printing operation under a condition where the rear surface of the sheet 2*a*1, which faces the contact type head, is pressed with the pressing member. Thus, the reality of simultaneously printing at the both surfaces becomes impossible, with a resultant need for preparing head feeding mechanisms in the respective print heads for the auxiliary scanning directions A2.

Further, the use of the press force control motor 11, composed of the direct motor which is able to provide a constant torque control, allows booklet-like medium 2 to be pressed with an arbitrary constant press force, making it possible for booklet-like medium 2 to be pressed with an arbitrary constant press force in a reliable manner. That is, in an event that the arbitrary press force is obtained with the use of a spring force, the length of the spring should be varied and, to this end, there is a need for adding a motor serving as a drive source for varying the spring position and a sensor for detecting the position of the spring, resulting in issues involving a complicated mechanism, increased costs and an unstable press force due to imbalance in the springs. In contrast, the presence of the constant torque control due to the direct motor does not undergo such issues.

Figure 20:
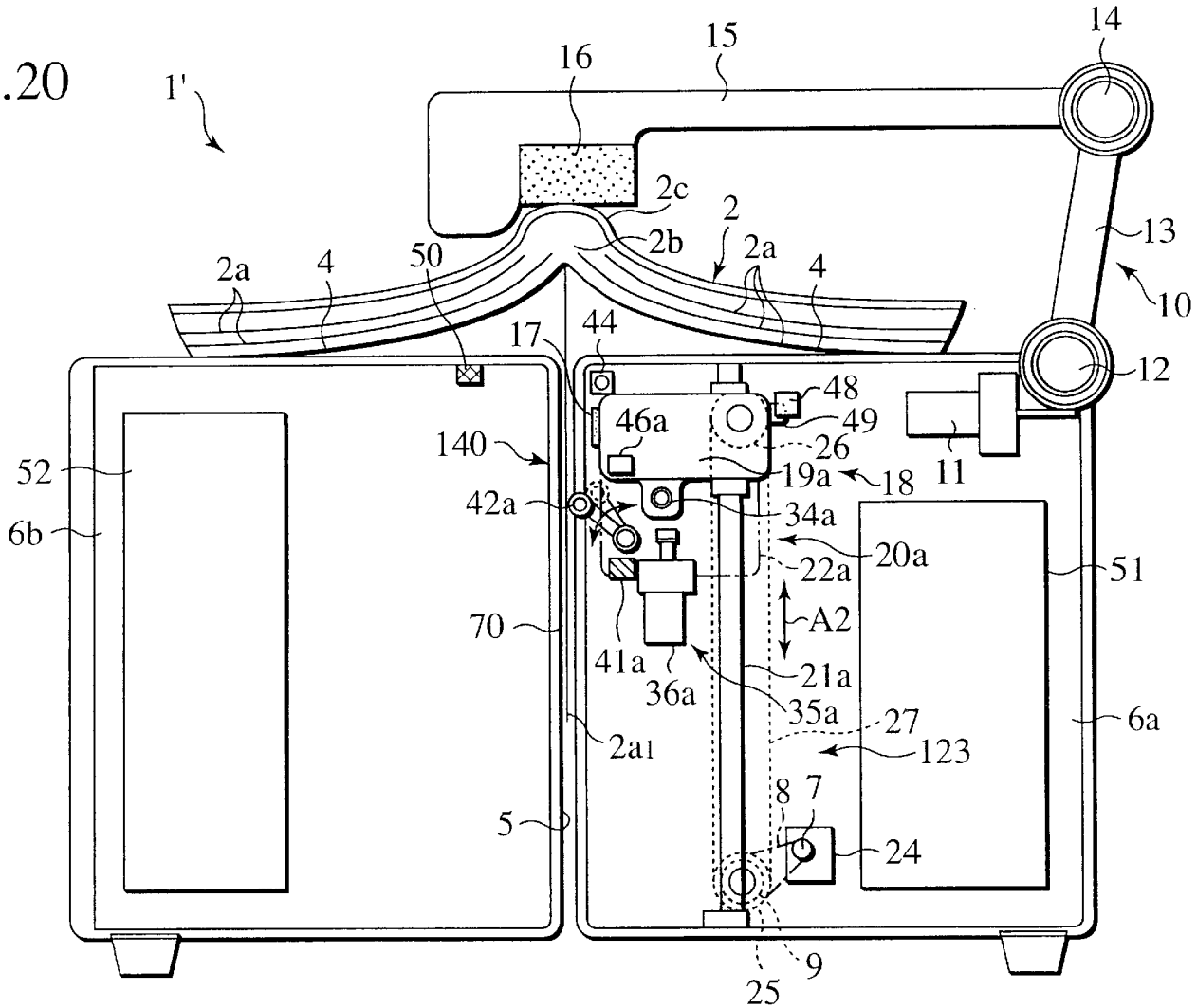
FIG. 20 is a schematic overall structural view, as viewed from a front side, of a single-side printing machine of a second preferred embodiment according to the present invention.
Figure 21:
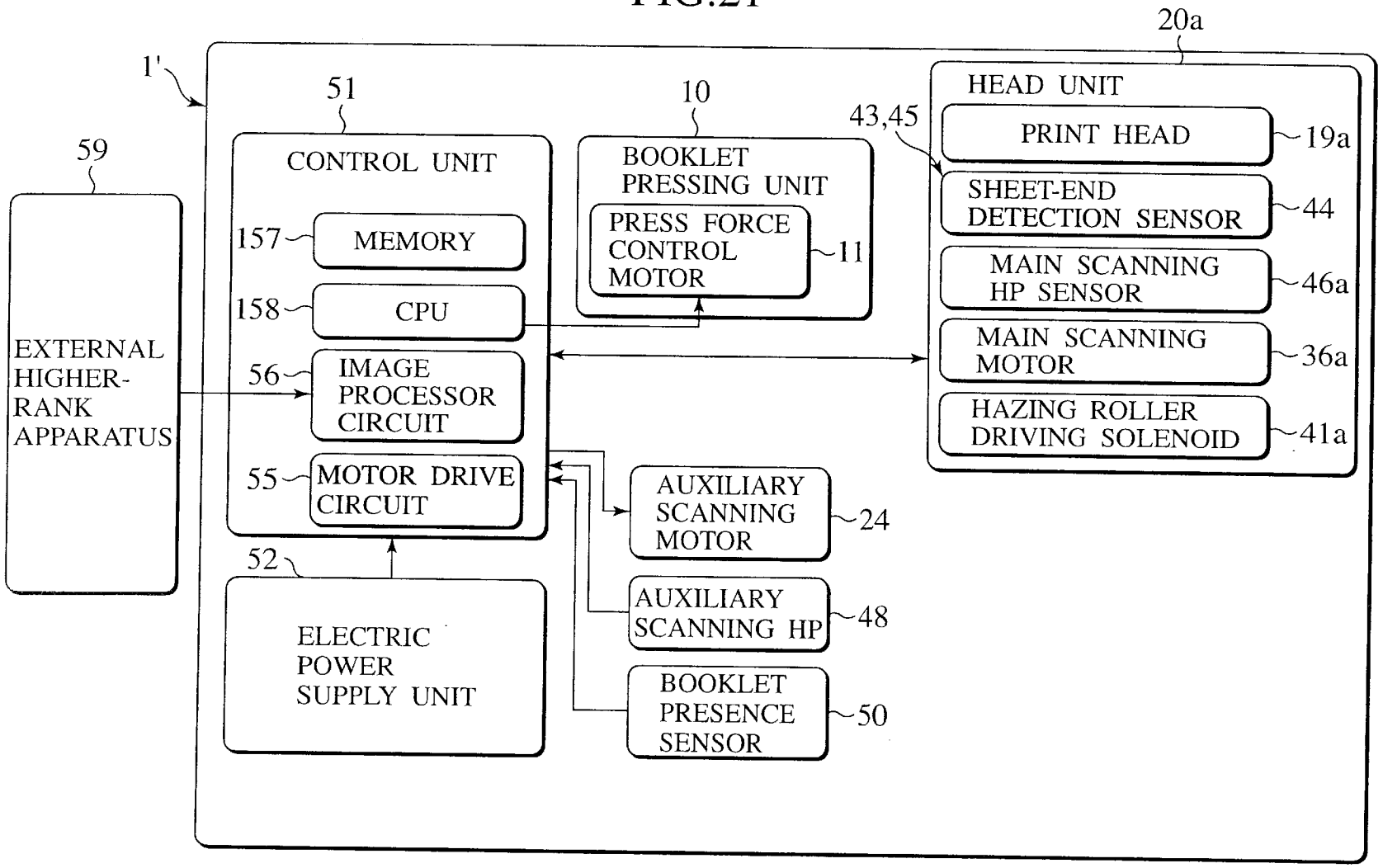
FIG. 21 is a block diagram of a schematic circuit of the single-side printing machine of the second preferred embodiment according to the present invention.
Figure 22:
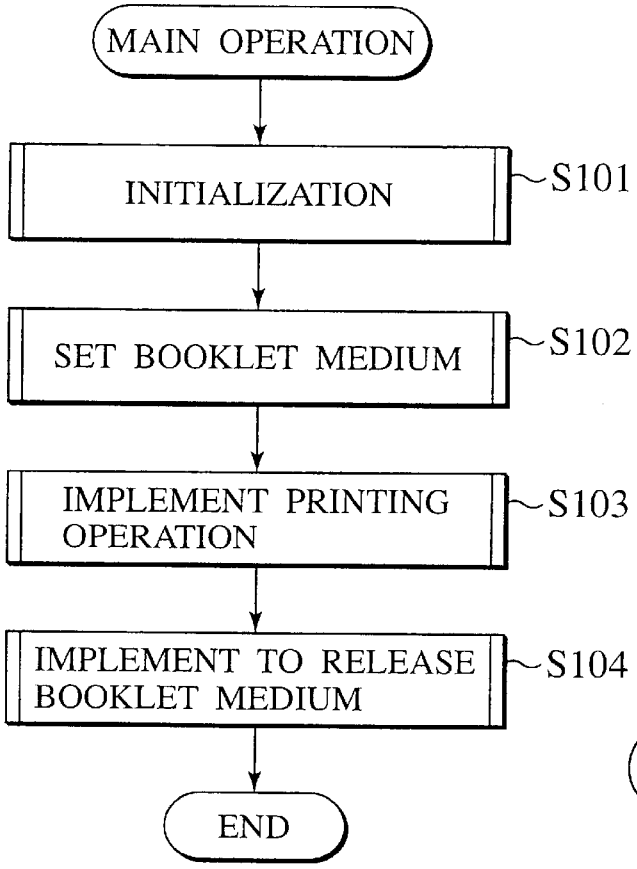
FIG. 22 is a flow chart of a basic operation of the printing machine of the second preferred embodiment according to the present invention.
Figure 23:
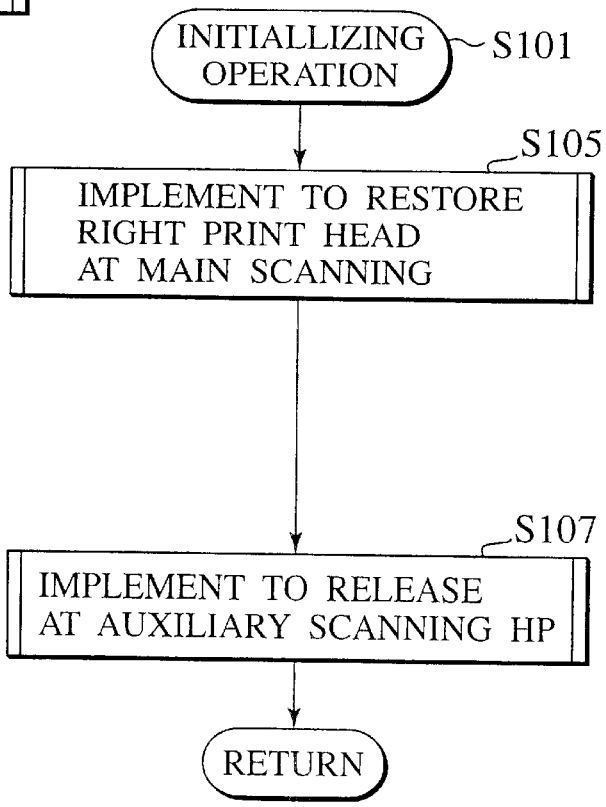
FIG. 23 is a flow chart illustrating initializing operation of the printing machine of the second preferred embodiment according to the present invention.
Figure 24:
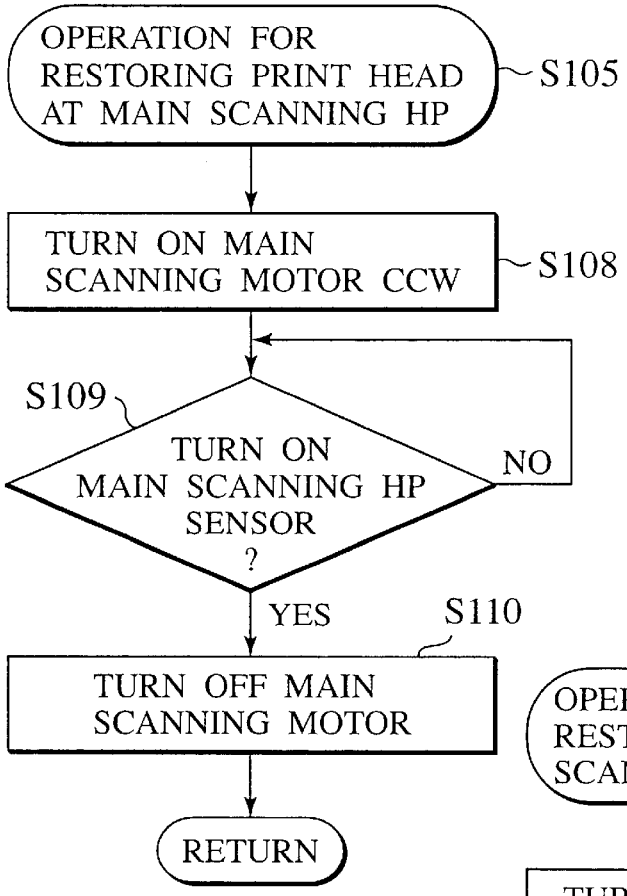
FIG. 24 is a flow chart illustrating main scanning home-position restoring operation of a single print head of the printing machine of the second preferred embodiment according to the present invention.
Figure 25:
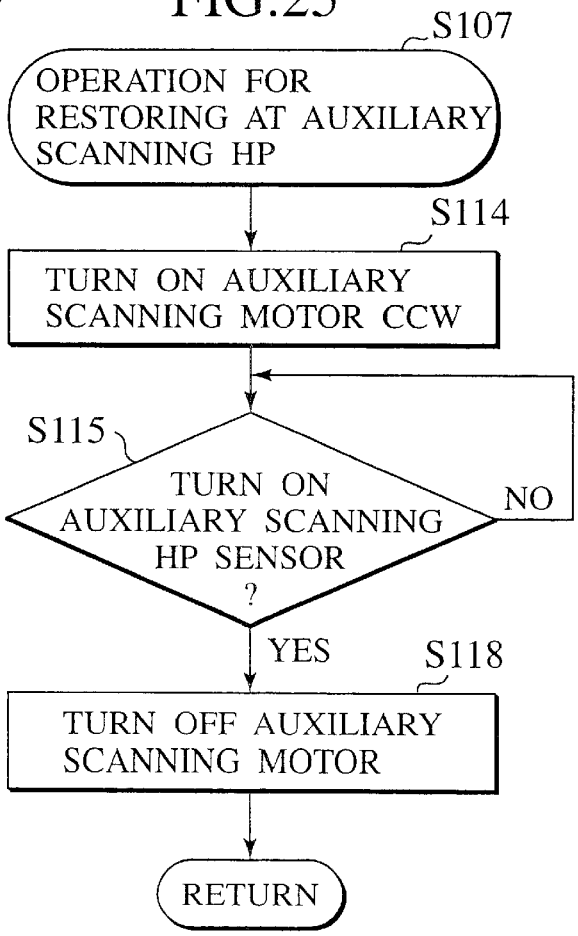
FIG. 25 is a flow chart illustrating auxiliary scanning home-position restoring operation of the printing machine of the second preferred embodiment according to the present invention.
Figure 26:
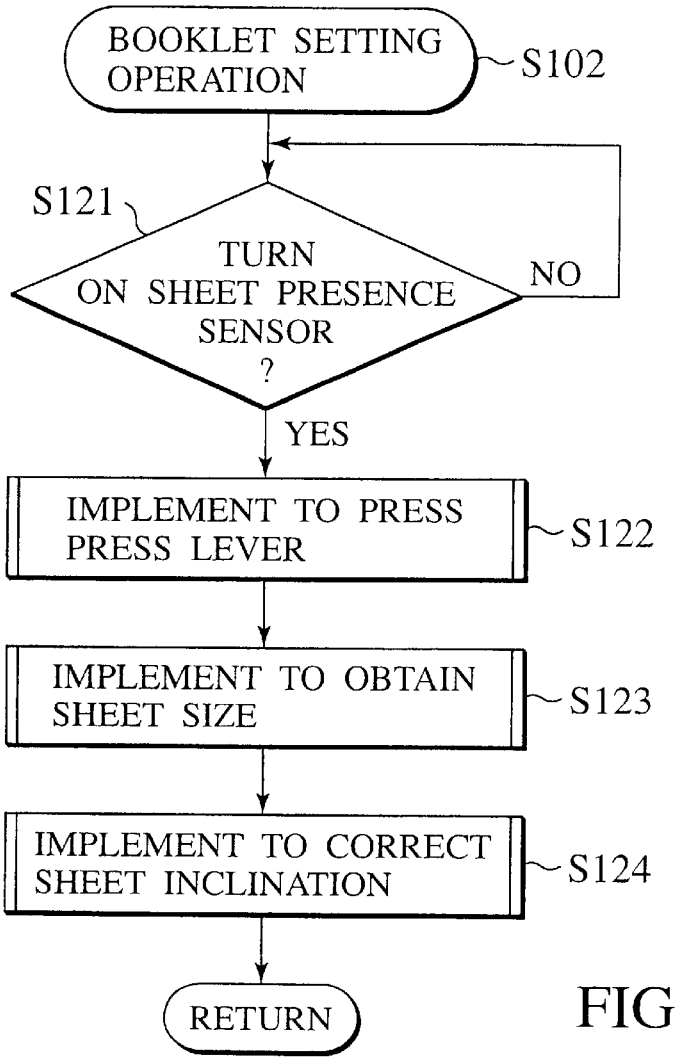
FIG. 26 is a flow chart illustrating setting operation of booklet-like medium of the printing machine of the second preferred embodiment according to the present invention.
Figure 27:
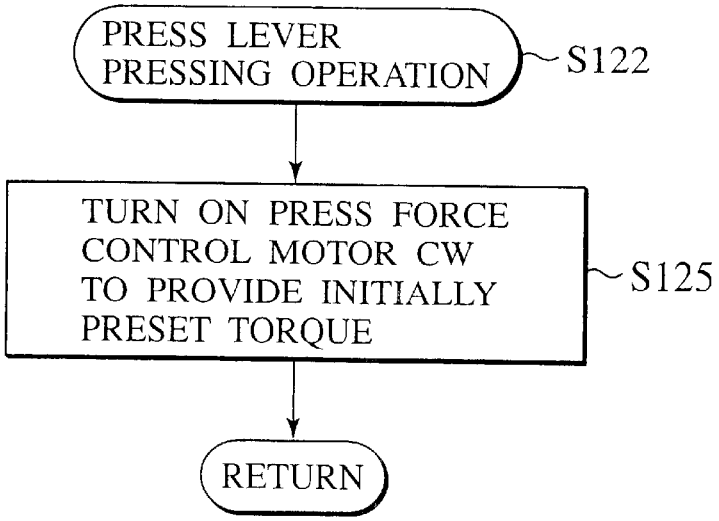
FIG. 27 is a flow chart illustrating pressing operation of a press lever of the printing machine of the second preferred embodiment according to the present invention.
Figure 28:
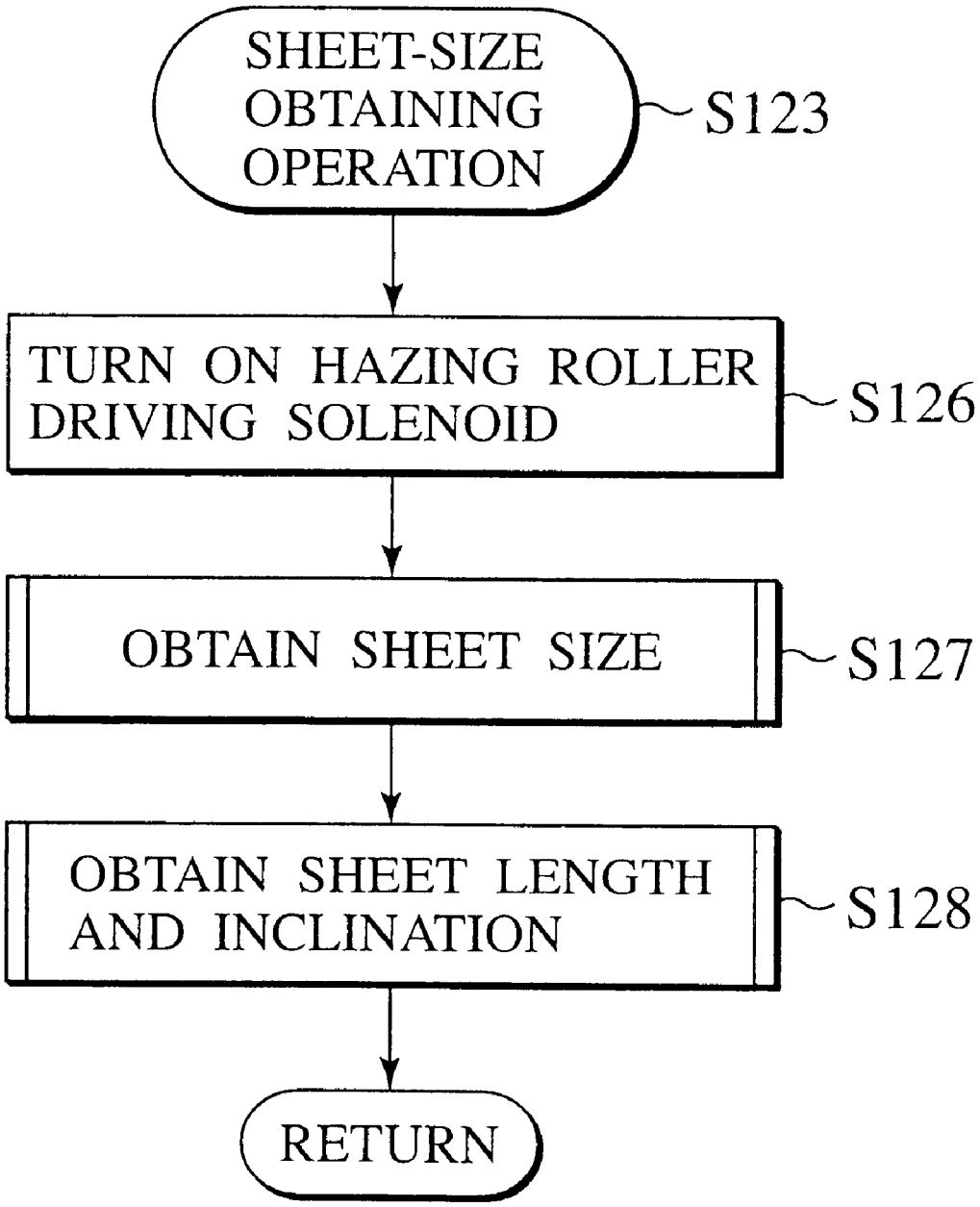
FIG. 28 is a flow chart illustrating sheet-size obtaining operation of booklet-like medium of the printing machine of the second preferred embodiment according to the present invention.
Figure 29:
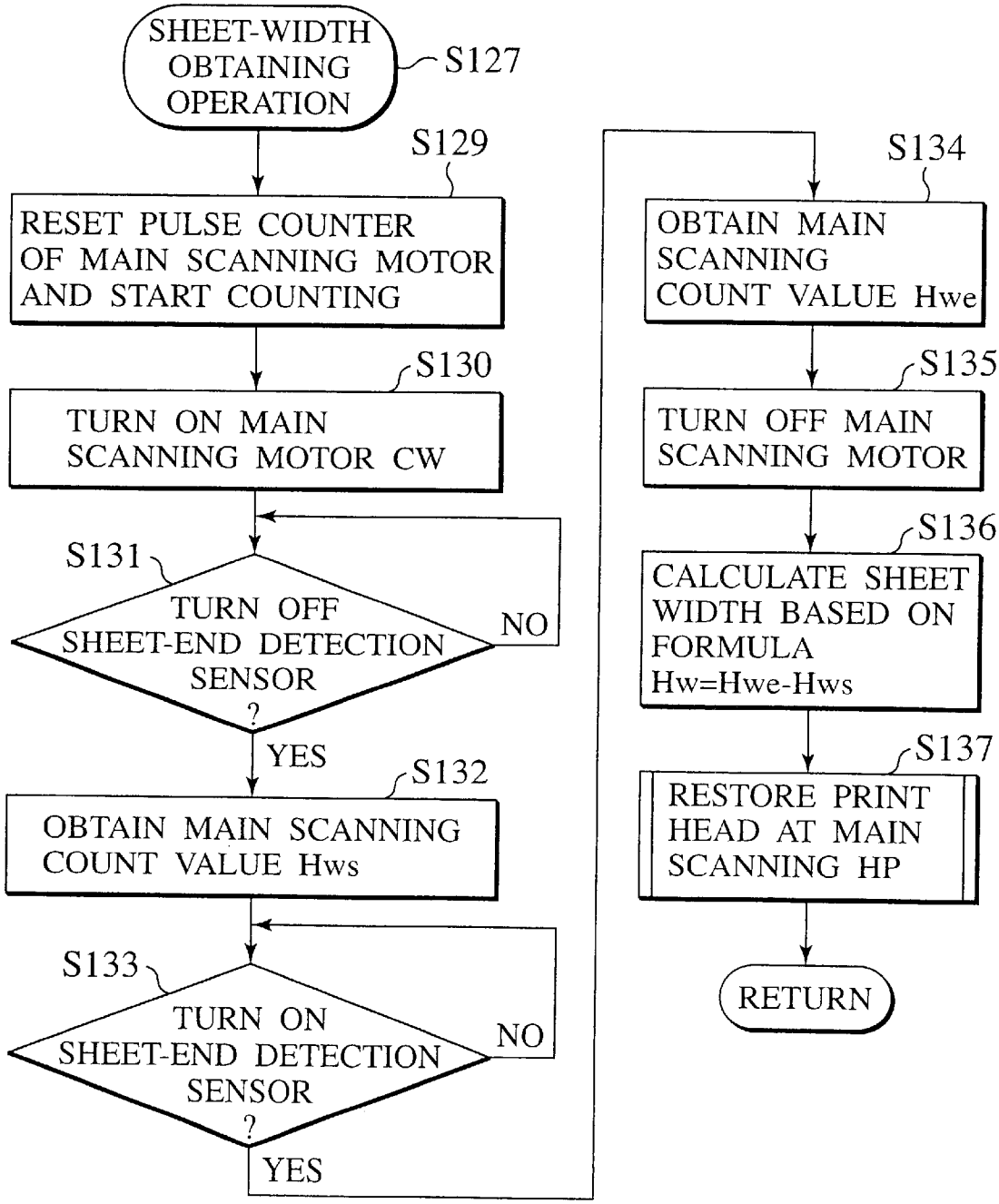
FIG. 29 is a flow chart illustrating sheet-width obtaining operation of the printing machine of the second preferred embodiment according to the present invention.
Figure 30:
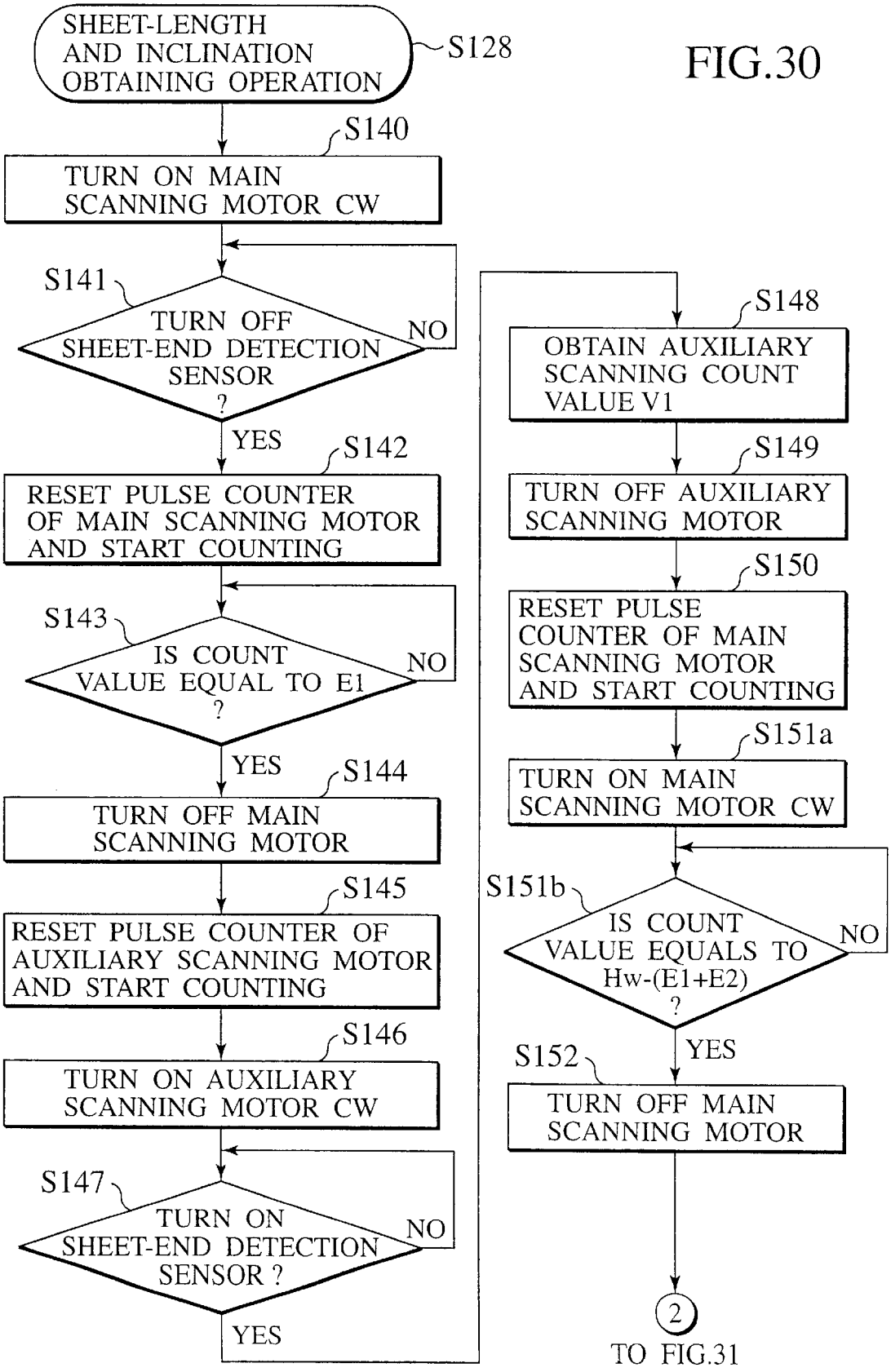
FIG. 30 is a flow chart illustrating a front half of sheet-length and sheet-inclination obtaining operation of the printing machine of the second preferred embodiment according to the present invention.
Figure 31:
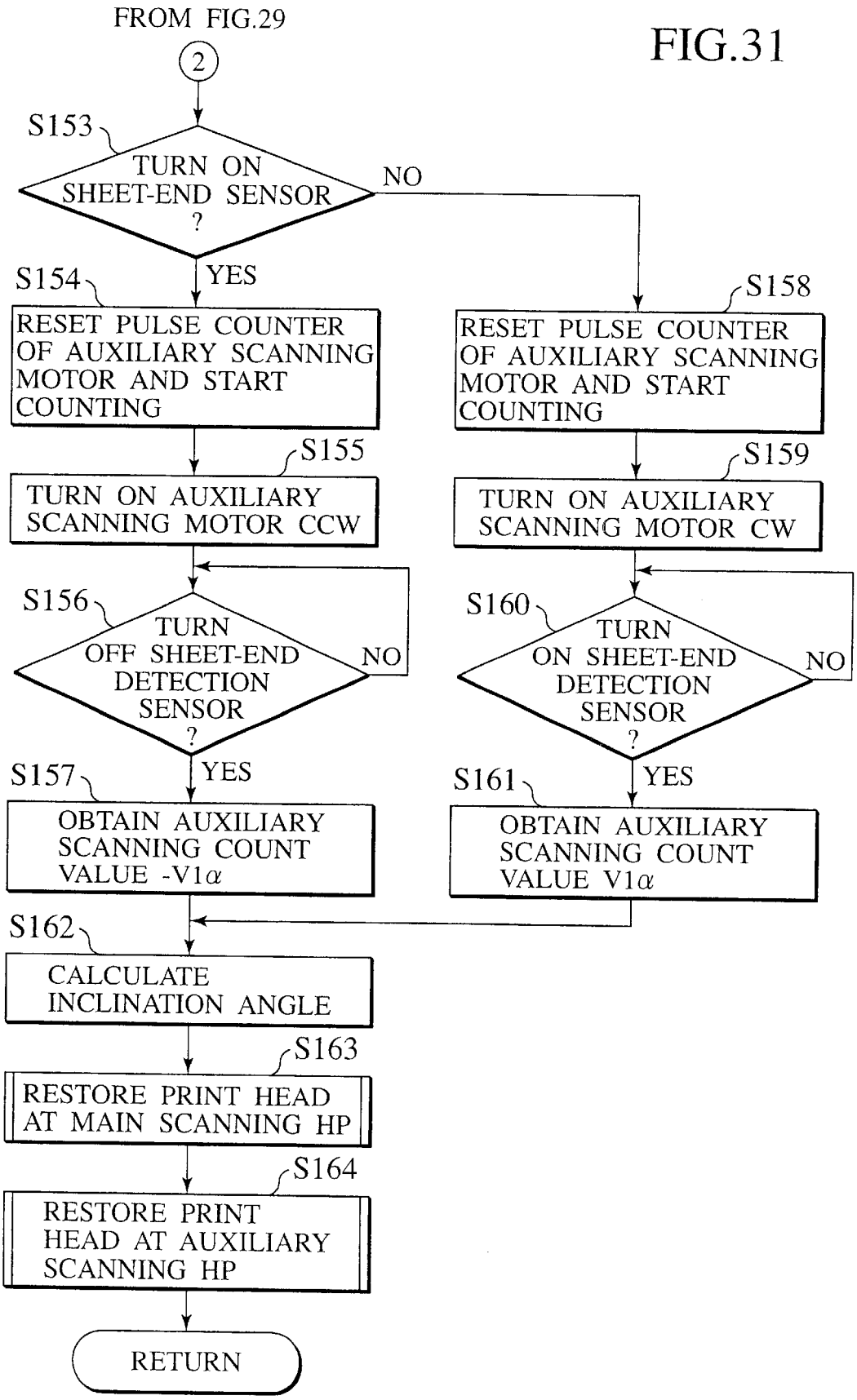
FIG. 31 is a flow chart illustrating a latter half of sheet-length and sheet-inclination obtaining operation of the printing machine of the second preferred embodiment according to the present invention.
Figure 32:
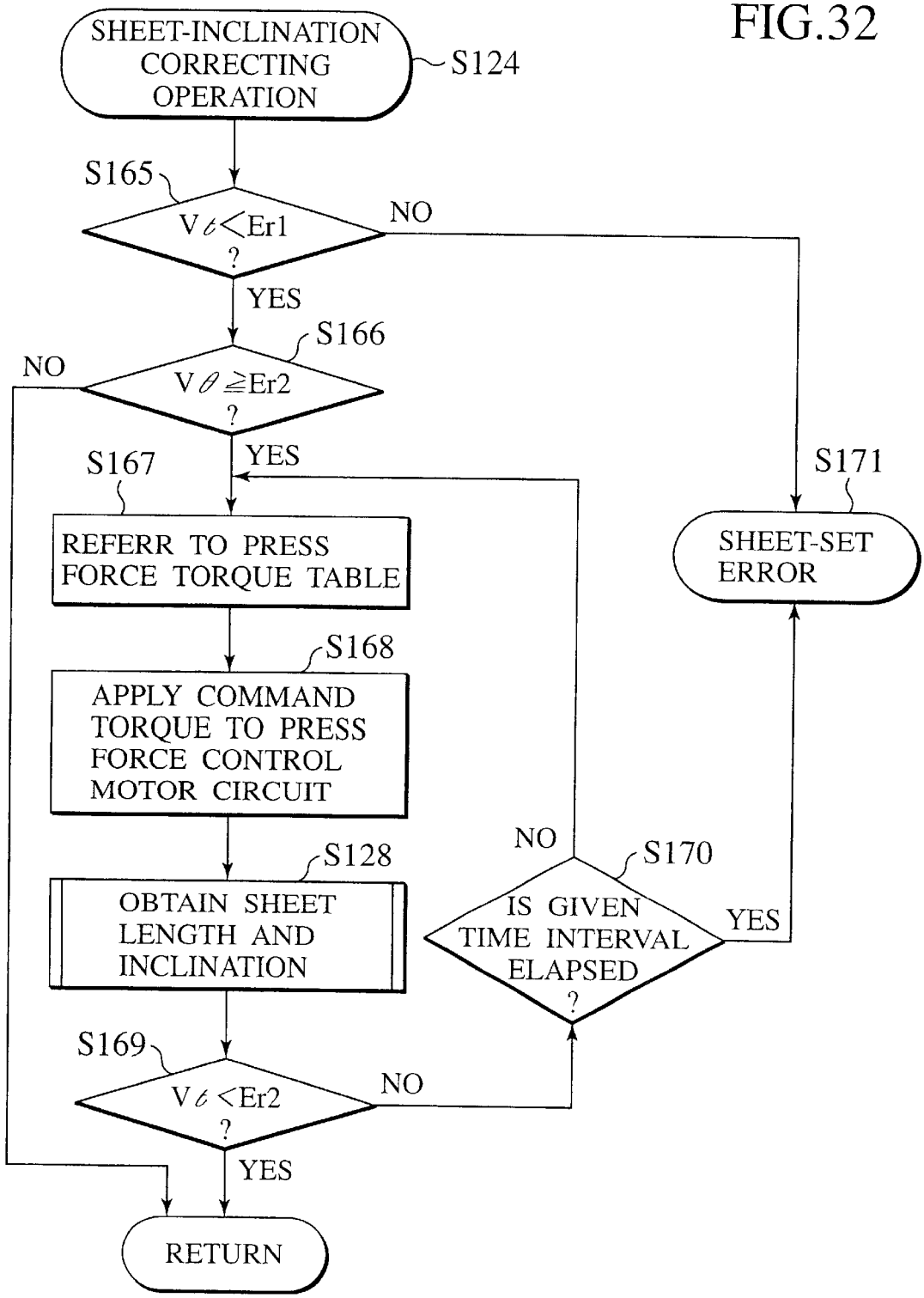
FIG. 32 is a flow chart illustrating sheet-set inclination correcting operation of the printing machine of the second preferred embodiment according to the present invention.
Figure 33:
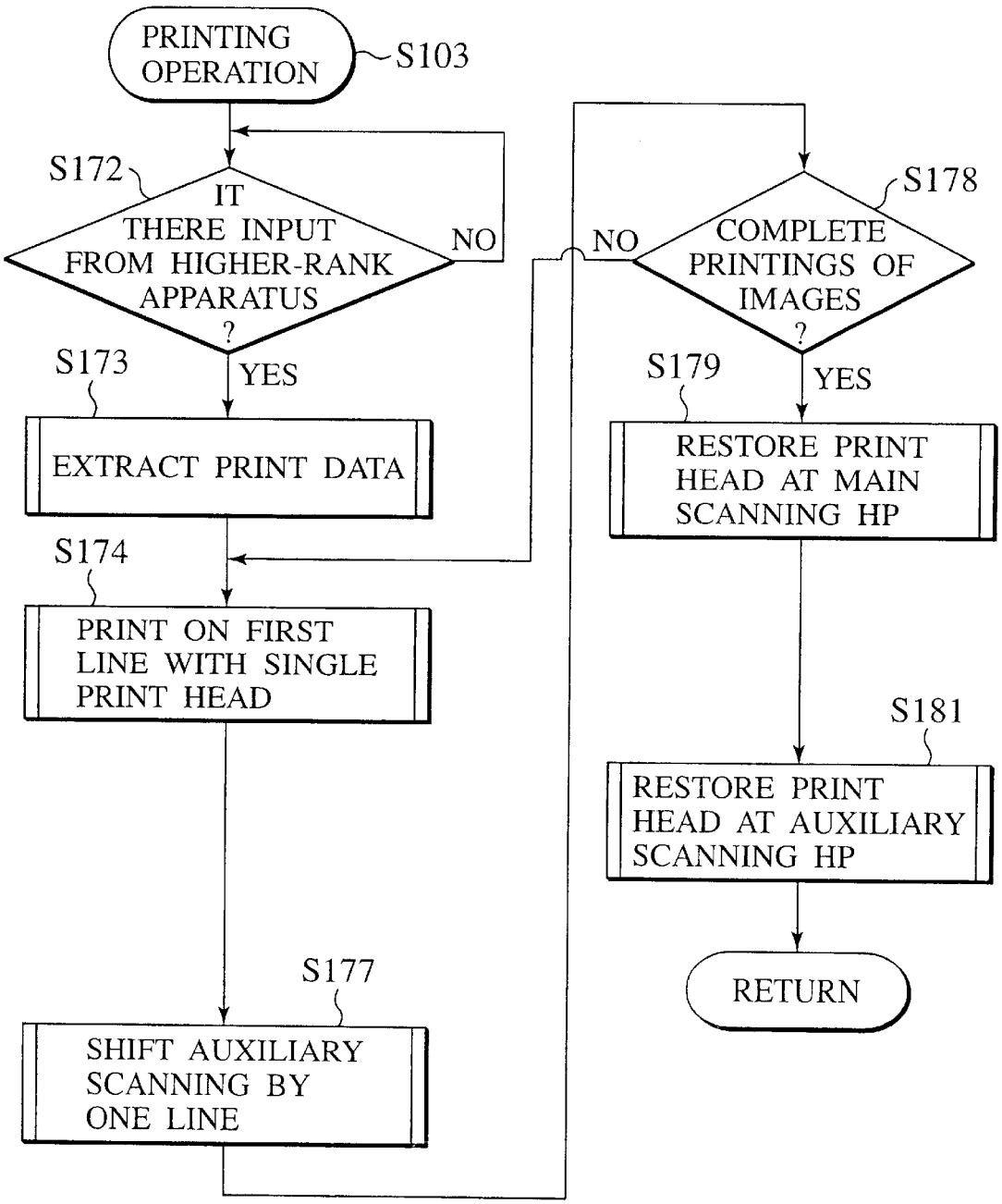
FIG. 33 is a flow chart illustrating printing operation of the printing machine of the second preferred embodiment according to the present invention.
Figure 34:
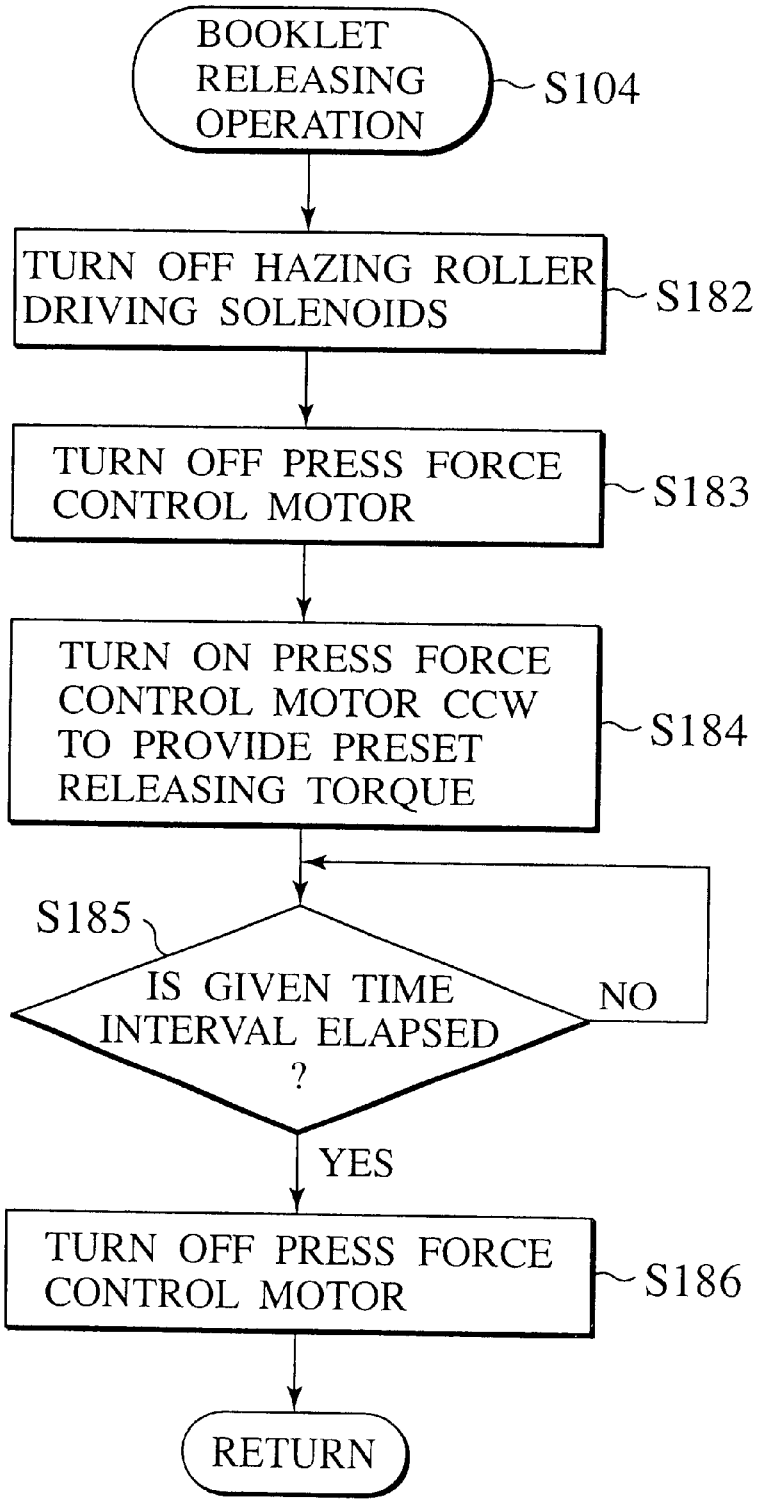
FIG. 34 is a flow chart illustrating booklet-like medium releasing operation of the printing machine of the second preferred embodiment according to the present invention.

FIGS. 20 to 34 shows a booklet medium printing machine of a second preferred embodiment according to the present invention, wherein FIG. 20 is a schematic view of the printing machine as viewed from a front side, FIG. 21 is a block diagram of a schematic circuit of the printing machine, FIG. 22 is a flow chart of an overall system of the printing machine, FIG. 23 is a flow chart for an initializing operation, FIG. 24 is a flow chart of a main scanning home-position restoring operation of a right printing head section, FIG. 25 is a flow chart of an auxiliary scanning home-position restoring operation of the printing head section, FIG. 26 is a flow chart of a setting operation of booklet-like medium, FIG. 27 is a flow chart of a pressurizing operation of a press lever, FIG. 28 is a flow chart of an obtaining process for a sheet-size, FIG. 29 is a flow chart of an obtaining operation for a sheet-width, FIG. 30 is a flow chart of a first half of an obtaining operation for the length and the inclination of the sheet, FIG. 31 is a flow chart of a latter half of an obtaining operation for the length and the inclination of the sheet, FIG. 32 is a flow chart of an operation for correcting an obliquely set sheet-position, FIG. 33 is a flow chart of a printing operation, and FIG. 34 is a flow chart of a releasing operation for the booklet medium.

As shown in FIG. 20, the printing machine 1' for booklet-like medium 2 of one-side print type is arranged to perform a printing operation of a desired sheet 2*a*1 of booklet-like medium 2 such as a pocketbook, a diary and a book each of which has a plurality of sheets (paper sheets, etc) 2*a* that are bound at a bound portion 2*b,* with a machine body 3 having an upper wall formed with a horizontally aligned booklet resting surface 4. Formed at a substantially center of the booklet resting surface 4 in a lateral direction is a sheet insertion passage 5 which is open and which has a width sufficient for allowing the thickest volume of sheets 2*a,* to be used in booklet-like medium 2, to be adequately inserted. And, the frame body 3 is divided into right and left part receiver compartments 6*a,* 6*b* with respect to a boundary of the sheet insertion passage 5.

As shown in FIG. 20, further, the printing machine 17 for booklet-like medium 2 of the one-side print type is comprised of a booklet pressing unit 10 for pressing booklet-like medium 2, whose sheet 2*a*1 of a print page, toward the booklet resting surface 4, a print page positioning unit 140 for positioning the sheet 2*a*1 of the print page to be printed, which has been inserted through the sheet insertion passage 5, at a given print position, and a print head section 18 for printing the sheets 2*a* of the print page to be printed which is positioned by the print page positioning unit 140.

As shown in FIG. 20, the booklet pressing unit 10 has the same structure as that of the first preferred embodiment and, so, like parts bears the same reference numerals as those of the first preferred embodiment to omit a detailed description of the same. Further, the booklet pressing unit 10 of the second preferred embodiment also serves as a sheet inclination correcting unit as in the first preferred embodiment.

The print head section 18 includes only a single unit 20 composed of a single print head 19*a,* with the head unit 20*a* being located in a right part receiver compartment 6*a*. The head unit 20*a* is comprised of a single vertically movable block 22*a* which is guided with a guide rod 21*a* which stands upright in the right part receiver compartment 6*a,* with the vertically movable block 22*a* being moved by an auxiliary scanning direction drive unit 123. The auxiliary scanning direction drive unit 123 is constructed in a structure wherein a drive system required for the left vertically movable block used in the first preferred embodiment is removed, with like parts bearing the same reference numerals to omit a description of the same parts.

In the second preferred embodiment, the single print head 19*a* has a structure which includes, like in the first preferred embodiment, a piezo-type ink jet head or a thermal type ink jet head having a head holder, which is not shown, and an ink tank detachably mounted to the head holder, with the ink jet head being replaceable while allowing ink to be injected on the sheet 2*a* to perform printing operation in a non-contact fashion.

As shown in FIG. 20, the print page positioning unit 140 includes a single hazing roller driving solenoid 41*a* which is fixedly supported with the right vertically movable block

22*a,* a sheet hazing roller 42*a* which is driven with the hazing roller driving solenoid 41*a* and which serves as a sheet pressing member, and a press force rest sheet 70 which is located over an entire area in a movable range of the sheet hazing roller 42*a* at a left side where the print head 19*a* is located, allowing the sheet hazing roller 42*a* to press the press force rest sheet 70 at an upstream side of an auxiliary scanning direction A2 of the print head 19*a* during printing operation. And, the presence of a positioning effect provided by the single sheet hazing roller 42*a* and the press force rest sheet 70 by which the sheet is sandwiched allows a desired sheet 2*a*1 of the print page to be located at an optimum print position with respect to the print head 19*a.*

The print page positioning unit 140 also includes a sheet size detection unit 43 and a sheet inclination detecting unit 45, with these units having the same structures as those of the first preferred embodiment and like parts bearing the same reference numerals for omitting a description of the same parts.

The main scanning home-position sensor 46*a* is mounted on the single vertically movable block 22*a* to detect whether the print head 19*a* remains at a main scanning home-position. A detail structure of this sensor is identical to that of the first preferred embodiment and a description of the same is omitted.

The auxiliary scanning home-position sensor 48 is mounted in the frame body 3 and is arranged to detect whether the vertically movable block 22*a,* i.e. the single print head 19*a* remains in the auxiliary scanning home-position. A detailed structure of this sensor is identical to that of the first preferred embodiment and a description of the same is herein omitted. Also, the control unit 51 and the electric power supply unit 52 are accommodated in the right and left part receiver compartments 6*a, 6b,* respectively.

Now, a control system of the printing machine 1' is described. As shown in FIG. 21, like in the first preferred embodiment, the control unit 51 incorporates therein the motor drive circuit 55, the image processor circuit 56, a memory 157 and a CPU (the Central Peripheral Unit) 158, etc. The motor drive circuit 55 and the image processor circuit 56 have the same structures as those of the first preferred embodiment. The memory 157 stores therein programs for implementing the flow charts shown in FIGS. 22 to 34 and stores various data such as press torque tables, etc.

Further, the CPU 158 is able to control read-out or write-in operations of the memory 157 and is arranged to receive sensor outputs produced from the sheet-end detection sensor 44, the main scanning home-position sensor 46*a,* the auxiliary scanning home-position sensor 48 and the booklet presence sensor 50. Thus, the CPU 158 serves to control the press force control motor 11, the auxiliary scanning motor 24 and the main scanning motors 36*a* by means of the motor drive circuit 55 to carry out the flow charts shown in FIGS. 22 to 34, to control the drive of the hazing roller driving solenoid 41*a* and to control the drive of the print head 20*a.* A detailed process of such a control is described below.

Now, the printing operation of the printing machine 1' is described in conjunction with the flow charts of FIGS. 22 to 34. It is to be noted here that, during clockwise (CW) rotations of the main scanning motor 36*a,* the print head 19*a* is caused to move in a direction away from the main scanning home-position whereas, during counter-clockwise (CCW) rotation of the motor 36*a,* the print head 19*a* is caused to move toward the main scanning home-position. It is also supposed that, during clockwise (CW) rotation of the auxiliary scanning motor 24, the print head unit 20*a,* i.e. the print head 19*a* is caused to move in a direction (downward direction) away from the auxiliary scanning home-position whereas, during counter-clockwise (CCW) rotation of the motor 24, the print head unit 20*a,* i.e. the print head 19*a* is caused to move toward the auxiliary scanning home-position. It is to be further noted that, during clockwise (CW) rotation of the press force control motor 11, the press lever 15 is caused to move from the wait position to the press position whereas, during counter-clockwise (CCW) rotation of the motor 11, the press lever 15 is caused to move from the press position to the wait position.

An operator unfolds booklet-like medium 2 in both sides such that the bound portion 2*b* assumes the center of the boundary of the desired sheet 2*a*1 to be printed, with only the desired sheet 2*a*1 to be printed being inserted through the sheet insertion passage 5 while placing the booklet-like medium 2 on the booklet resting surface 4. And, print data, etc. is specified and selecting print start command allows printing operation to be carried out.

First, a whole concept in operation of the printing operation involves an initializing operation (in Step S101) as shown in FIG. 22 and, subsequently, a booklet setting operation is carried out to set booklet-like medium 2 placed on the booklet resting position 4 (in Step S102). Successively, the printing operation is carried out to print on the sheet 2*a*1 of booklet-like medium 2 (in step S103). Finally, booklet-releasing operation is implemented to allow booklet-like medium 2, which has been placed on the booklet resting surface 4, to be released (in step S104). Hereinafter, respective operating steps are described in sequence.

As shown in FIG. 23, in the initializing operation (step S101), a restoring step is implemented to restore the print heads 19*a* at the main scanning home-position (in steps S105) and restoring operation is implemented to restore the print head 19*a* at the auxiliary scanning home-position (in step S107).

More particularly, as shown in FIG. 24, the single main scanning motor 36*a* is reversed (in step S108) and operation is performed to check the change-over timing between the turning-on and turning-off of the main scanning home-position sensor 46*a* (in step S109). And, when the beam of detection light of the main home-position sensor 46*a* is interrupted with the light interruptive plate (not shown) such that, when the output is switched over from the turned-off state to the turned-on state, the drive of the main scanning motor 46*a* is stopped (in step S110). Thus, the single print head 19*a* is restored at the main scanning home-position.

Next, as shown in FIG. 25, the auxiliary scanning motor 24 is reversed (in step S114) and operation is performed to check the change-over timing between the turning-on and turning-off of the auxiliary scanning in home-position sensor 48 (in step S115). And, when the beam of detection light of the main scanning home-position sensor 48 is interrupted with the light interruptive plate 49 such that, when the output is switched over from the turned-off state to the turned-on state, the drive of the auxiliary scanning motor 24 is stopped (in step S116). Thus, the print head 19*a* is restored at the main scanning home-position.

As shown in FIG. 26, the booklet setting operation (step S102) involves the steps of checking the output of the booklet presence sensor 50 (in step S121), pressing the press lever (in step S122) in the presence of booklet-like medium 2, obtaining the sheet size (in step S123) and correcting the sheet inclination (in step S124). In particular, as shown in FIG. 27, the press lever pressing step (step S122) includes the step of driving the press force control motor 11 clockwise at an initially preset torque (in step S125). Then, the press lever 15 is moved downward from its wait position to compel the press pad 16 to be shifted into the press position wherein the backbone 2*c* of booklet-like medium 2 is pressurized. The press force control motor 11 is continuously driven at the initially preset torque, thereby causing booklet-like medium 2 to be pressed against the booklet resting surface 4 with the press force of such an initially preset torque.

As shown in FIG. 28, the sheet size obtaining operation (step S123) includes the steps of turning on single hazing roller driving solenoid 41*a* (in step S126), obtaining the sheet width (in step S127) and obtaining the sheet length and inclination (in step S128) under a condition where the desired sheet 2*a*1 is held in fixed place with the single hazing roller 42*a*.

As shown in FIG. 29, the sheet width obtaining operation (step S127) includes the steps of resetting the pulse counter of the main scanning motor 36*a* to set the pulse counter in its start condition (in step S129) and driving the main scanning motor 36*a* clockwise (in step S130). And, operation is carried out for checking the output of the sheet-end detection sensor 44 such that, when the output of the sheet-end detection sensor 44 is changed over from the turned-on state to the turned-off state (in step S131), operation is implemented to obtain the count value Hws of the pulse counter of the main scanning motor 36*a* (in step S132).

In next step, the output of the sheet-end detection sensor 44 is continuously monitored and, when the output of the sheet-end detection sensor 44 is changed over from the turned-off state to the turned-on state (in step S133), the count value Hwe of the pulse counter of the main scanning motor 36*a* is obtained (in step S134) and thus the main scanning motor 36*a* is turned off (in step S135). That is, as shown in FIG. 5, the count value Hws represents a value indicative of a distance between the main scanning home-position and a proximity edge of the sheet 2*a*1, and the count value Hwe represents a value indicative of a distance between the main scanning home-position and a remotest edge of the sheet 2*a*1.

In next step, computation is implemented based on a formula of Hw=Hwe−Hws to calculate the sheet width Hw (in step S136). And, the right print head 19*a* is restored to the main scanning home-position to complete the operation (in step S137).

As shown in FIGS. 30 and 31, the sheet length and inclination obtaining operation (step S128) includes the steps of driving the main scanning motor 36*a* clockwise (in step S140) and monitoring the output of the sheet-end detection sensor 44 such that, when the output of the sheet-end detection sensor 44 is changed over from the turned-on state to the turned-off state (in step S141), the pulse counter of the main scanning motor 36*a* is reset, thereby setting the pulse counter in its count start condition to begin the counting operation (in step S142). And, when the count value equals a value of E1 (which is an arbitrary constant), the main scanning motor 36*a* is turned off (in step S144). Next, the pulse counter of the auxiliary scanning motor 24 is reset to render the counter to remain in the start condition (in step S145), and the auxiliary scanning motor 24 is driven clockwise (in step S146). And, the output of the sheet-end detection sensor 44 is monitored and, when the output of the sheet-end detection sensor 44 is changed over from the turned-off state to the turned-on state (in step S147), the count value V1 of the pulse counter of the auxiliary scanning motor 24 is obtained (in step S148) and the auxiliary scanning motor 24 is stopped (in step S149).

Next, as shown in FIG. 30, the pulse counter of the main scanning motor 36*a* is reset to render this counter in its start condition (in step S150), and the main scanning motor 36*a* is driven clockwise (in step S151*a*). And, when the count value equals Hw−(E1+E2) (in step (S151*b*), the main scanning motor 36*a* is turned off (in step S152). That is, the position where the count value equals Hw−(E1+E2) is plotted at point a in FIG. 5 that represents the edge of the sheet 2*a*1 in the absence of the inclination with respect to the main scanning direction A1 of the print head 19*a,* and that corresponds to a position to allow the sheet 2*a*1 to be shifted outward (at a position shown in FIG. 5) or inward in the presence of the inclination of the sheet 2*a*1.

Subsequently, the output of the sheet-end detection sensor 44 is checked (in step S153) and, if the output of the sheet-end detection sensor 44 is ON, i.e. if the sheet-end detection sensor 44 is shifted to the position (shown in FIG. 5) outside the sheet 2*a*1, the pulse counter of the auxiliary scanning motor 24 is reset, rendering this counter in its start condition (in step S154) while driving the auxiliary scanning motor 24 counter-clockwise to allow the print heads 19*a,* 19*b* to raise upward (in step S155). And, the output of the sheet-end detection sensor 44 is monitored and, when the output of the sheet-end detection sensor 44 is changed over from the turned-on state to the turned-off state (in step S156), the count value of −V1α of the pulse counter of the auxiliary scanning motor 24 is obtained (in step S157).

Further, if the output of the sheet-end detection sensor 44 remains at the off level, i.e. if the sheet-end detection sensor 44 is located at the position that is shifted inward, the pulse counter of the auxiliary scanning motor 24 is reset to render this counter to assume a start condition (in step S158) while driving the auxiliary scanning motor 24 clockwise to lower the print head 19*a* (in step S159). And, when the output of the sheet-end detection sensor 44 is checked, if the output of the sheet-end detection sensor 44 is changed over from the turned-off state to the turned-on state (in step S160), the count value V1α of the pulse counter of the auxiliary scanning motor 24 is obtained (in step S161). That is, as shown in FIG. 5, the count values −V1α, V1α represent the values that correspond to the distances shifted to the edge of the sheet 2*a*1.

Subsequently, as shown in FIG. 31, operation is implemented to calculate the inclined angle of the sheet 2*a*1 according to a formula Vθ=tan−1(|V1α|/Hw) (in step S162). And, the single print head 19*a* is returned to the main scanning home-position (in step S163), while returning the print heads 19*a* to the auxiliary scanning home-position to complete the operation (in step S164). Also, when it is desired to obtain the inclined angle Vθ in a more accurate manner, computation is carried out by substituting Hw for Hw−(E1+E2) in the above computation formula.

Next, as shown in FIG. 32, the sheet inclination correcting operation (step S124) includes the step of checking whether or not the inclined angle Vθ of the sheet 2*a*1 has a relationship Vθ<Er1 (wherein Er1 represents the improper printing angle) (in step S165). In the absence of relationship Vθ<Er1, that is, if the inclined angle Vθ exceeds the allowable correcting range, then, operation is implemented to carry out a sheet-set error correction (in step S171). The sheet-set error correction involves the step of providing the display of such an operation to compel the operator to correctly set the booklet medium 2. If Vθ<Er1, i.e. if the inclined angle of the sheet 2a1 remains in the correctable range even in the worst case, operation is carried out to check whether there exist the relation Vθ≧Er2 (wherein Er2 is the printable angle) (in step S166). If the inclined angle Vθ is less than Er2, then, the operation is terminated. If the inclined angle Vθ is greater than Er2, operation is implemented to obtain a command torque value (that corresponds to a torque value greater than the initially preset torque) which corresponds the inclined angle Vθ by referring to the press force torque table stored in the memory 157 (in step S167), thereby altering the number of revolutions of the press force control motor 11 to a value determined by the command torque (in step S168). Then, booklet-like medium 2 is pressed with a further higher press force than before, thereby causing the sheet 2a1 of booklet-like medium 2 to be normally shifted in a direction to correct the inclination. Here, the correlated data of the press force torque table is settled such that a larger torque is applied in proportion to the magnitude of the inclined angle.

As shown in FIG. 32, upon completion of the step for correcting the inclination of the sheet by the press lever 15, operation is performed again to implement the step of obtaining the sheet length and inclination (step S128) and to check whether the inclined angle Vθ of the sheet 2a1 remains in the range of Er2 or is out of that range (in step S169). In case of the inclined angle Vθ having a value less than Er2, the operation is terminated. In case of the inclined angle Vθ having a value not less than Er2, the press lever 15 is operated to repeatedly perform the inclination connection, and, even with a given time period that has been elapsed, if the inclined angle Vθ is not decreased to a value below Er2, operation is implemented to perform the step of correcting the sheet-set error (in step S171). Upon repeated execution of the inclination correction using the press lever 15, if the inclined angle Vθ is lower than Er2, then the operation is terminated.

As shown in FIG. 33, the printing operation (step S1033) includes the step of checking whether or not there is the input, involving image data, applied from the higher rank apparatus 59 (in step S172). And, in the presence of the input data such as image data etc., image data is extracted and converted into print data with the image processor circuit 56, with resulted print data being applied to respective driver circuits of the print heads 19*a,* 19*b* which in turn are operated to inject ink from the injections nozzles 17 to execute printing on respective first lines (in steps S174). And, upon termination of the printing on the first line with the single print heads 19*a,* the auxiliary scanning motor 24 is rotated at a given angle determined by the given number of pulses and shifted by one line in the auxiliary scanning direction A2 (in step S177), thereby permitting the single print head 19*a* to implement printing on the second line (in step S174). Upon termination of such an operation executed on whole lines, when the printings representative of one image are completed (in step S178), the single print head 19*a* is returned to the main scanning home-position (in step S179) and, simultaneously, the auxiliary scanning home-position is restored (in step S181) to complete the whole operation.

As shown in FIG. 34, the booklet releasing operation (step S104) includes the step of turning off the single hazing roller driving solenoids 41*a* (in step S182), allowing the single hazing roller 42*a* to be shifted to the wait position to release the sheet 2a1. Subsequently, the press force control motor 11 is turned off (in step S183) and, then, the press force control motor 11 is reversed with a preset given releasing torque for a given time interval whereupon the motor is stopped (in steps S184 to S186). As such, the press lever 15 is raised from its press position toward the wait position wherein the pres lever is shifted away from the backbone 2*c* of booklet-like medium 2. Thus, it is possible for the operator to freely remove booklet-like medium 2 from the booklet resting surface 4.

With such a printing machine 1' for booklet-like medium 2, like in the first preferred embodiment, there are conditions where different volumes of thickness are obtained in dependence on the number of sheets shared in right and left areas when booklet-like medium 2 is centrally unfolded in the bound portion 2*b* in double-sided conditions at a boundary line of the sheet 2a1 to be printed. Booklet-like medium 2, which is unfolded in the double sides, is pressed against the booklet resting surface 4 with the booklet pressing unit 10 while, at the same time, only a desired sheet 2a1 to be printed is inserted to the sheet insertion passage 5, with the inserted sheet 2a1 being positioned by the print page positioning unit 140. Thus, the sheet 2a1 can be printed with the print head section 18 under a condition where the sheet is positioned with the print page positioning unit 140 without being adversely affected with the thickness or the curved surfaces of the sheets 2*a* that are divided into the right and left areas when the booklet medium is centrally unfolded in the bound portion 2*b*. Consequently, it is possible for the sheet 2a1 of a particular page to be printed under an appropriate printing condition without causing the sheet to be printed from being formed with a curved surface regardless of the right and left volumes of the thickness.

Therefore, there is no need for various detection means for adjusting the print head section and the sheet for printing to be adjusted in a given correlated relationship, and adjusting means associated with these detection means as would required in the related art practice. More particularly, in an event that the sheets 2*a* which are bounded has a large number of pages and, also, the sheets 2*a* lack firmnesses, if the booklet medium is centrally unfolded in both sides at the bound portion 2*b,* the sheets 2*a* are formed with curved surfaces with large curvatures over an extended area. It is possible for such booklet-like medium 2 to be printed without totally forming the curved surfaces and, thus, it is effective to perform printing on such booklet-like medium 2.

Further, with such a printing machine 1', the presence of the print head 19*a* located at one side of the sheet 2a1 enables one surface of the sheet 2a1 to be printed. Furthermore, since the booklet pressing unit 10 is arranged to press the backbone 2*c* of booklet-like medium 2 against the booklet resting surface 4, the press force of the booklet pressing unit 10 is directly applied to the bound portion 2*b* of booklet-like medium 2 in a direction to compel the same to become closer to the booklet resting surface 4 such that the bound portion 2*b* is rendered to be closer to the booklet resting surface 4 in an effective manner with a week press force. Accordingly, it is possible for the sheet 2a1 of the particular page for printing to be deeply inserted through the sheet insertion passage 5 with the week press force.

In addition, with such a printing machine 1', the print page positioning unit 140 includes the single sheet hazing roller 42*a,* that is moved in an interlocking relationship with the movement of the print head 19*a* in the auxiliary scanning direction A2, and the press force rest sheet 7 that is located in the position opposed to the print head 19*a,* enabling the sheet hazing roller 42*a* to be pressed against the press force rest sheet 70 at the upstream side of the auxiliary scanning direction A2 of the print head 19*a* during the printing operation. As a result, since the sheet 2a1 is supported under pressure with the sheet hazing roller 42*a* and the press force rest sheet 70 at an area close proximity to the print position of the print head 19*a* and at the upstream side of the auxiliary scanning direction A2 during the printing operation, the sheet can be reliably positioned at the area where the printing is executed with the print head 19*a* without causing the sheet hazing roller 42*a* to press the printed area after the printing operation for thereby preventing ink of the print area from spreading out.

Further, with such a printing machine 1', since the print head 19*a* of the print head section 18 is located to be moveable in a direction to be perpendicular to a direction parallel to the longitudinal direction of the bound portion 2*b* of booklet-like medium 2, it is possible to carry out the printing operation in two-dimensional areas which the print head 19*a* is rendered to scan and such print head is suited for use as the print head unit of the ink jet type which carries an ink tank. Furthermore, the presence of the sheet size detection unit 43 that detects the size of the sheet 2*a*1, of the particular page to be printed, which is inserted through the sheet insertion passage 5 enables the sheet of various sizes to be printed at a suitable printing area. Also, it is possible to prevent errors such as ink to be coated over an area where the sheet 2*a*1 is not positioned and there is no opportunity for internal parts of the printing machine to be stained with ink.

In addition, with such printing machine 1', the presence of the sheet inclination detection unit 45 that detects the inclination of the desired sheet 2*a*1, of the particular page to be printed, which is inserted through the sheet insertion passage 5 enables the inclination of the sheet 2*a*1, of the page to be printed, that is inserted through the sheet insertion passage 5 to be detected, thereby precluding the opportunity for the sheet 2*a*1 to be obliquely printed. Further, the presence of the booklet pressing unit 10 that serves as the sheet inclination correcting unit for correcting the inclined condition of the sheet 2*a*1, of the particular page to be printed, which is inserted through the sheet insertion passage 5 allows the booklet pressing unit 10, which serves as the sheet inclination correcting unit, to correct the inclined condition of the sheet 2*a*1, of the particular page to be printed, that is inserted through the sheet insertion passage 5 when the sheet inclination detecting unit 45 has detected the inclined condition of the sheet 2*a*1. Thus, when the sheet 2*a*1 remains in the inclined condition, the inclined condition of the sheet 2*a*1 is automatically corrected by the booklet pressing unit 10 which serves as the sheet inclination correcting unit. As a consequence, it is possible for the print sheet 2*a*1 from being obliquely printed with no need for the operator to carry out the inclination correcting operation of the sheet 2*a*1.

Further, with such a printing machine 1' of the second preferred embodiment, when the sheet inclination detection unit 45 detects the inclined condition of the sheet, the booklet pressing unit 10 actuates to increase the magnitude of press force to be applied to booklet-like medium 2. As booklet-like medium 2 is strongly pressed against the resting surface 4, a particular area where the degree of proximity near the bound portion 2*b* is weak is pressed against and shifted toward the booklet resting surface 4, with a resultant correction in the inclined state of the sheet 2*a*1 of the page to be printed for thereby precluding the sheet from being obliquely printed. Furthermore, since the booklet pressing unit 10 also serves as the sheet inclination correcting unit, there is no need for providing a separate sheet inclination correcting unit, resulting in a decrease in the number of component parts and in simplified structure of the printing machine.

Further, with the printing machine 17 of the second preferred embodiment, like in the first preferred embodiment, the use of the press force control motor 11, composed of the direct motor which is able to provide a constant torque control, allows booklet-like medium 2 to be pressed with an arbitrary constant press force, making it possible for booklet-like medium 2 to be pressed with an arbitrary constant press force in a reliable manner. That is, in an event that the arbitrary press force is obtained with the use of a spring force, the length of the spring should be varied and, to this end, there is a need for adding a motor serving as a drive source for varying the spring position and a sensor for detecting the position of the spring, resulting in issues involving a complicated mechanism, increased costs and an unstable press force due to imbalance in the springs. In contrast, the presence of the constant torque control due to the direct motor does not undergo such issues.

Also, according to the first and second preferred embodiments, the present invention concerns an important advantage in that the presence of the single sheet-end detection sensor 44 arranged to detect the sizes in a widthwise direction (in the main scanning direction) and in a longitudinal direction (in the auxiliary scanning direction) of the sheet 2*a*1 and to detect data necessary for detecting the inclination of the sheet 2*a*1 enables the use of a minimum number of sensors to be mounted. It is possible for the time to be detected to be shortened for thereby obtaining a rapid printing operation, provided that the respective detection data are detected with respective sensors. Also, for example, in order to detect the inclination of the sheet 2*a*1, a plurality of sheet-end detection sensors may be located on the vertically movable block 22*a* (or 22*b*) in spaced relationship, allowing inclined data of the sheet 2*a*1 to be obtained in response to a difference in timings at which the edge of the sheet is detected with the respective sheet-end detection sensors, when the vertically movable block 22*a* (or 22*b*) is moved in the main scanning direction, for thereby enabling the inclination of the sheet 2*a*1 to be rapidly detected.

In addition, while, in the first and second preferred embodiments, inclination correction of the sheet 2*a*1 is carried out with the booklet pressing unit 10, image data may be modified to perform inclination correction to allow image data, wherein the inclination correction is implemented, to be used for printing for thereby forming print image on the sheet 2*a*1 without inclination. Also, the inclination correction of image may be performed in the higher-rank apparatus 59 to compel preliminarily inclination-corrected image data to be input.

Further, according to the first preferred embodiment, the print page positioning unit 14 includes the pair of sheet hazing rollers 42*a*, 42*b* which rotate on and move over the sheet 2*a*1 in the interlocking relationship with the movement with the print heads 19*a*, 19*b* in the auxiliary scanning direction A2, enabling the sheet 2*a*1 to be positioned while preventing the sheet 2*a*1 from being damaged as small as possible.

Furthermore, according to the second preferred embodiment, the print page positioning unit 140 includes the single sheet hazing roller 42*a* which rotates on and moves over the sheet 2*a*1 in the interlocking relationship with the movement of the print head 19*a* in the auxiliary scanning direction A2, enabling the sheet 2*a*1 to be positioned and while preventing the sheet 2*a*1 from being damaged as small as possible as attained in the first preferred embodiment. Also, of course, the print page positioning units 40 and 140 may be of the structures which are able to position the sheet 2*a*1 at the print position and may be of the types which are not moved in the interlocking relationship with the movement of the print heads 19*a*, 19*b*, but may be of the types which are fixedly mounted to the machine body 3 and which have, for example, structures to merely press and support an outside area of an effective print surface of the sheet 2*a*1.

In addition, in the first and second preferred embodiments, an interlocking switch may be mounted at a distal end of the press lever 15 for detecting whether an object, that is pressed, is booklet-like medium 2 or the other product to preclude the booklet setting operation from being implemented in the presence of the other product placed on the booklet resting surface 4, thereby precluding the press lever 15 from being inadvertently actuated to protect the operator's hand from being pinched between the press lever 15 and the booklet resting surface 4.

Furthermore, according to the first and second preferred embodiments, the presence of the booklet resting surface 4 formed with a horizontal surface which is an upper surface of the machine body 3 provides an advantage wherein it is easy for the operator to place booklet-like medium 2 in an easy fashion. However, the booklet resting surface 4 may be formed in a vertical plane. Specifically, the printing machine 1' of the single side print type of the second preferred embodiment has an advantage in that the ink injecting direction of the print head 19*a* is settled to be oriented just below the same.

As previously described above, according to one aspect of the present invention, while there are conditions where booklet-like medium has different volumes of thickness in dependence on the number of sheets shared in right and left areas when booklet medium is centrally unfolded in the bound portion into double-sided conditions at a boundary line of the sheet to be printed, booklet-like medium, which is unfolded in the double-sided conditions, is pressed against the booklet resting surface with the booklet pressing unit while, at the same time, only a desired sheet to be printed is inserted to the sheet insertion passage, with the inserted sheet being positioned by the print page positioning unit. Thus, the sheet can be printed with the print head section under a condition where the sheet is positioned with the print page positioning unit without being adversely affected with the thickness or the curved surfaces of the sheets that are divided into the right and left areas when booklet-like medium is centrally unfolded in the bound portion. Consequently, it is possible for the sheet of a particular page to be printed under an appropriate printing condition without causing the sheet, to be printed, from being formed with a curved surface regardless of the right and left volumes of the thickness. Therefore, there is no need for various detection means for adjusting the print head section and the sheet for printing to be adjusted in a given correlated relationship, and adjusting means associated with these detection means as would required in the related art practice. More particularly, in an event that the sheets which are bounded has a large number of pages and, also, the sheets lack firmnesses, if booklet-like medium is centrally unfolded in both sides at the bound portion, the sheet is formed with the curved surface with the large curvature over an extended area. It is possible for such a booklet medium to be printed without totally forming the curved surface and, thus, it is effective to perform printing on such a booklet medium.

According to the second aspect of the present invention, the bound portion of booklet-like medium is directly exerted with the press force applied by the booklet pressing unit in a direction to cause the bound portion to be closer to the booklet resting surface such that the bound portion is rendered to be closer to the booklet resting surface with the week press force, enabling the sheet of the page to be printed to be deeply inserted to the sheet insertion passage with the weak press force.

According to the third aspect of the present invention, since the sheet is pressed and retained at all times at the region close proximity to the area where printing is implemented with the print head and at the region upstream of the auxiliary scanning direction during the printing operation, it is possible for the sheet to be reliably positioned at the region where the printing has to be implemented while precluding the sheet pressing unit to press the printed region to prevent the generation of ink blots.

According to the fourth aspect of the present invention, since the sheet is pressed and retained at all times at the region close proximity to the area where printing is implemented with the print head and at the region upstream of the auxiliary scanning direction during the printing operation, it is possible for the sheet to be reliably positioned at the region where the printing has to be implemented while precluding the sheet pressing unit to press the printed region to prevent the generation of ink blots.

According to the fifth aspect of the present invention, the print head is able to perform printing in the two-dimensional area where the scanning is possible with the print head and is suited for use in a print head of an ink jet type which carries an ink tank.

According to the sixth aspect of the present invention, the presence of the sheet size detecting unit which detects the size of the sheet, of the page to be printed, inserted to the sheet insertion passage allows the sheet of various sizes to be printed at an appropriate printing area. Further, since it is possible to prevent the error wherein ink is applied to areas where the sheet is not located, thereby precluding the inner area of the printing machine from being contaminated with ink.

According to the seventh aspect of the present invention, if there is the inclination of the sheet, of the page to be printed, inserted to the sheet insertion passage, the inclination of the sheet is detected with the sheet inclination detection unit for precluding the sheet from being obliquely printed.

According to the eleventh aspect of the present invention, in the event that the sheet remains in the inclined condition, the inclined condition of the sheet is automatically corrected with the sheet inclination correction unit, thereby preventing the operator from being suffered with work for correcting the inclination of the sheet while preventing the sheet from being obliquely printed.

According to the tenth aspect of the present invention, when booklet-like medium is strongly pressed against the booklet resting surface, a particular area where the degree of proximity near the bound portion is weak is pressed against and shifted toward the booklet resting surface, with a resultant correction in the inclined state of the sheet, of the page to be printed, for thereby precluding the sheet from being obliquely printed such that there is no need for providing a separate sheet inclination correcting unit, resulting in a decrease in the number of component parts and in simplified structure of the printing machine.

What is claimed is:

1. A printing machine, for booklet-like medium, which has a booklet resting surface to which a sheet insertion passage is opened, comprising:

a booklet pressing unit for pressing booklet-like medium, which is centrally unfolded on the booklet resting surface at a bound portion with a sheet, of a page to be printed, that is inserted to the sheet insertion passage, against the booklet resting surface;

a print page positioning unit for positioning the sheet, of the page to be printed and inserted through the sheet insertion passage, at a given print position; and a print head section for printing on at least one surface of the sheet, of the page to be printed, which is positioned with the print page positioning unit.

2. The printing machine for booklet-like medium according to claim 1, wherein:

the booklet pressing unit serves to press a backbone of booklet-like medium against the booklet resting surface.

3. The printing machine for booklet-like medium according to claim 1, wherein:

the print head section includes a pair of print heads located at both sides of the sheet, of the page to be printed and inserted through the sheet insertion passage, respectively, for performing a double-side printing operation; and the print page positioning unit includes a pair of sheet pressing members which are movable in an interlocking relationship with the pair of print heads movable in an auxiliary scanning direction, and which serve to pinch the sheet at areas upstream of the auxiliary scanning direction of the print heads during printing operation.

4. The printing machine for booklet-like medium according to claim 3, wherein:

the print heads of the print head section are movable in a direction parallel to and perpendicular to a longitudinal direction of the bound portion of booklet-like medium, respectively.

5. The printing machine for booklet-like medium according to claim 1, wherein:

the print head section includes a print head located at one side of the sheet, of the page to be printed and inserted through the sheet insertion passage, for performing a single-side printing operation; and the print page positioning unit includes a sheet pressing member which is movable in an interlocking relationship with the print head movable in an auxiliary scanning direction, and a press force rest sheet located at the other side of the sheet, the sheet pressing member serving to press the press force rest sheet at an area upstream of an auxiliary scanning direction of the print head during printing operation.

6. The printing machine for booklet-like medium according to claim 1, further comprising:

a sheet size detecting unit for detecting a size of the sheet of the page to be printed and inserted through the sheet insertion passage.

7. The printing machine for booklet-like medium according to claim 1, further comprising:

a sheet inclination detecting unit for detecting an inclination of the sheet of the page to be printed and inserted through the sheet insertion passage.

8. The printing machine for booklet-like medium according to claim 7, further comprising:

a sheet inclination correcting unit for correcting an inclined condition of the sheet of the page to be printed and inserted through the sheet insertion passage, the sheet inclination correcting unit serving to correct the inclined condition of the sheet when the inclined condition of the sheet is detected by the sheet inclination detecting unit.

9. The printing machine for booklet-like medium according to claim 8, wherein:

the sheet inclination correcting unit compels the booklet pressing unit to increase the magnitude of a press force to be exerted to booklet-like medium.

10. A printing machine, for booklet-like medium having a bound portion, comprising;

a frame body including a booklet resting surface having a sheet insertion passage adapted to receive sheet of a page to be printed when booklet-like medium is unfolded in both sides on the booklet resting surface;

a booklet pressing unit mounted on the frame body for pressing the bound portion of booklet-like medium unfolded on the booklet resting surface such that the bound portion is closer to the booklet resting surface;

a print page positioning unit mounted in the frame body for positioning the sheet, of the page to be printed and inserted through the sheet insertion passage, at a given print position; and a print head section movably supported in the frame body for printing on at least one surface of the sheet, of the page to be printed, which is positioned with the print page positioning unit.

11. The printing machine for booklet-like medium according to claim 10, further comprising:

a press force control unit supported in the frame body and coupled to the booklet pressing unit for controlling the magnitude of press force to be exerted to the bound portion of booklet-like medium.

12. The printing machine for booklet-like medium according to claim 10, wherein:

the print head section includes a pair of print heads located in the frame body at both sides of the sheet insertion passage for executing double-side printing on the sheet inserted through the sheet insertion passage; and the print page positioning unit includes a pair of sheet pressing members which are movably associated with the pair of print heads to pinch the sheet at the given print position during printing operation.

13. The printing machine for booklet-like medium according to claim 10, wherein:

the print head section includes a single print head located in the frame body at one side of the sheet inserted through the insertion passage for executing single-side printing on the sheet inserted through the sheet insertion passage; and the print page positioning unit includes a single sheet pressing member which is movably associated with the single print head and a press force rest sheet located at the other side of the sheet inserted through the sheet insertion passage, the sheet pressing member serving to press the sheet against the press force rest sheet at the given print position.

14. The printing machine for booklet-like medium according to claim 10, further comprising:

a sheet size detecting unit for detecting a size of the sheet inserted through the sheet insertion passage.

15. The printing machine for booklet-like medium according to claim 10, further comprising:

a sheet inclination detecting unit for detecting an inclination of the sheet inserted through the sheet insertion passage.

16. The printing machine for booklet-like medium according to claim 15, further comprising:

a sheet inclination correcting unit for correcting an inclined condition of the sheet inserted through the sheet insertion passage, the sheet inclination correcting unit serving to correct the inclined condition of the sheet when the inclined condition of the sheet is detected by the sheet inclination detecting unit.

17. A printing machine, for booklet-like medium having a bound portion, comprising;

frame means including a booklet resting surface having a sheet insertion passage adapted to receive sheet of a page to be printed when booklet-like medium is unfolded in both sides on the booklet resting surface;

means for pressing the bound portion of booklet-like medium unfolded on the booklet resting surface such that the bound portion is closer to the booklet resting surface;

means for positioning the sheet, of the page to be printed and inserted through the sheet insertion passage, at a given print position; and print head means for printing on at least one surface of the sheet, of the page to be printed, which is positioned with the print page positioning unit.

* * * * *